US010510210B2

(12) United States Patent
Williams et al.

(10) Patent No.: US 10,510,210 B2
(45) Date of Patent: Dec. 17, 2019

(54) SKILLS-BASED, PARIMUTUEL SPORTS WAGERING ON MOBILE DEVICES

(71) Applicant: BetMIX, LLC, Hunt Valley, MD (US)

(72) Inventors: David C. Williams, Nicholasville, KY (US); Calvin J. Martin, Blacksburg, VA (US); William H. Jackson, Parkton, MD (US)

(73) Assignee: BetMIX, LLC, Hunt Valley, MD (US)

( * ) Notice: Subject to any disclaimer, the term of this patent is extended or adjusted under 35 U.S.C. 154(b) by 0 days.

(21) Appl. No.: 15/969,305

(22) Filed: May 2, 2018

(65) Prior Publication Data

US 2019/0340879 A1 Nov. 7, 2019

(51) Int. Cl.
*G07F 17/32* (2006.01)
*G06Q 50/34* (2012.01)

(52) U.S. Cl.
CPC ..... *G07F 17/3258* (2013.01); *G06Q 50/34* (2013.01); *G07F 17/3225* (2013.01); *G07F 17/3288* (2013.01)

(58) Field of Classification Search
CPC ..... G07F 17/3258; G07F 17/3288; G07F 17/3225; G06Q 50/34
See application file for complete search history.

(56) References Cited

U.S. PATENT DOCUMENTS 2,179,698 A 11/1939 Levy et al.
2,182,875 A 12/1939 Levy
5,411,258 A 5/1995 Wilson
5,830,068 A * 11/1998 Brenner ..... G06Q 50/34 463/42
5,846,132 A * 12/1998 Junkin ..... A63F 3/081 463/42
6,358,150 B1 3/2002 Mir
6,383,074 B1 5/2002 Boggs
6,450,887 B1 9/2002 Mir
6,736,725 B2 5/2004 Burns
8,636,571 B2 * 1/2014 Miller ..... G07F 17/3288 463/25
8,764,538 B2 * 7/2014 Lutnick ..... G07F 17/32 463/16
8,814,700 B2 8/2014 Vlazny
9,047,737 B2 * 6/2015 Brooks ..... G07F 17/3288
(Continued)

*Primary Examiner* — William H McCulloch, Jr.
(74) *Attorney, Agent, or Firm* — Larry J. Guffey, Esq.; Pamela K. Riewerts, Esq.; Oliver & Grimsley, LLC

(57) ABSTRACT

An improved wagering system, that enables a player with a mobile device to place a wager of any one of many available wager types and on any one of a plurality of upcoming order-of-finish contests (UOOFCs), includes a networked server that has a database containing data relevant to prior order-of-finish contests (POOFCs) and with instructions that cause the server to cooperate with the mobile device to: (a) register and establish a player account, (b) provide handicapping factors from which the player may select a handicapping factor for use in predicting the outcome of an UOOFC, (c) identify which of the provided handicapping factors was the most-accurate in predicting the outcome of the POOFCs, (d) apply the selected handicapping factor to predict an outcome for the UOOFC, and (e) identify a wagering strategy that includes a recommended type of wager and the contestant on which to place the recommended type of wager.

20 Claims, 21 Drawing Sheets

(56) References Cited

U.S. PATENT DOCUMENTS

| | | | | |
|---|---|---|---|---|
| 9,053,608 | B2 | 6/2015 | Brooks | |
| 9,384,622 | B2 * | 7/2016 | Vlazny | G07F 17/3288 |
| 9,437,078 | B2 | 9/2016 | Keech | |
| 9,443,392 | B2 * | 9/2016 | Keech | G07F 17/3288 |
| 9,747,748 | B2 | 8/2017 | Corckran | |
| 2002/0142816 | A1 * | 10/2002 | Stronach | G06Q 50/34 463/6 |
| 2004/0210507 | A1 * | 10/2004 | Asher | G06Q 40/00 705/37 |
| 2004/0229671 | A1 * | 11/2004 | Stronach | G06Q 50/34 463/6 |
| 2004/0235542 | A1 * | 11/2004 | Stronach | G06Q 30/06 463/6 |
| 2005/0003878 | A1 * | 1/2005 | Updike | G06Q 50/34 463/16 |
| 2005/0116410 | A1 * | 6/2005 | Vlazny | G07F 17/32 273/139 |
| 2005/0176496 | A1 * | 8/2005 | Stronach | G07F 17/32 463/25 |
| 2007/0275781 | A1 * | 11/2007 | Marshall | G06Q 30/02 463/42 |
| 2010/0144428 | A1 * | 6/2010 | Fontaine | G06Q 50/34 463/28 |
| 2015/0302698 | A1 * | 10/2015 | Keech | G07F 17/3288 463/16 |
| 2015/0364009 | A1 * | 12/2015 | Keech | G07F 17/3225 463/28 |

* cited by examiner

FIG. 3C

Sign Up

Step 1 of 4
What's your birthday?
MM * / DD * / YYYY *

*Step 2 of 4*
What's your phone number?

*Step 3 of 4*
What's your zipcode?

< BACK NEXT >

FIG. 3D

Sign Up

Step 4 of 4
Terms and Conditions

Track Kings Terms Of Use

TERMS OF USE

This website is provided by Betmix, LLC (collectively "Betmix"), subject to the following terms and conditions ("Terms"). By using this website, you agree to these Terms.

CHANGES TO THE WEBSITE AND TO THE TERMS

In preparing this website, Betmix has tried to include accurate, complete and current information; however, there are

FINISH SIGNUP

By tapping the "Finish Signup" button above, I agree to the Terms and Conditions.

< BACK

FIG. 6

| Handicapping Factor Applicability Evaluation (using the results of identified, prior races having similar races conditions) | | | | | | | | |
|---|---|---|---|---|---|---|---|---|
| Similar Historical Races | Finishing Positions of the Top-Ranked Horses According to the Listed Below Handicapping Factors | | | | | | | |
| | Best Lifetime Speed | Best Speed @ This Track | Best Speed On Turf | Best Speed On Off Track | Best Speed @ This Distance | Best Speed In Last 3 Races | Avg. Speed In Last 3 Races | Best 2 of Last 3 Avg. |
| 12/26/2017, Fair Grounds 8 | 1 | 1 | 1 | 5 | 4 | 7 | 6 | 4 |
| 12/2/2017, Fair Grounds 6 | 4 | 3 | 5 | 4 | 1 | 1 | 1 | 3 |
| 12/2/2017, Fair Grounds 1 | 5 | 7 | 6 | 3 | 2 | 5 | 4 | 2 |
| 04/02/2017, Fair Grounds 10 | 3 | 4 | 3 | 6 | 3 | 5 | 5 | 4 |
| 04/02/2017, Fair Grounds 3 | 4 | 4 | 2 | 1 | 5 | 3 | 2 | 5 |
| 04/01/2017, Fair Grounds 14 | 6 | 1 | 4 | 6 | 4 | 1 | 1 | 5 |
| 03/30/2017, Fair Grounds 9 | 2 | 3 | 5 | 2 | 1 | 8 | 7 | 4 |
| 03/26/2017, Fair Grounds 6 | 3 | 7 | 1 | 2 | 2 | 9 | 4 | 1 |
| 03/26/2017, Fair Grounds 6 | 1 | 6 | 1 | 3 | 7 | 4 | 4 | 3 |
| 03/26/2017, Fair Grounds 5 | 6 | 3 | 1 | 4 | 8 | 12 | 9 | 1 |
| 03/23/2017, Fair Grounds 7 | 4 | 1 | 7 | 3 | 11 | 3 | 2 | 3 |
| 03/19/2017, Fair Grounds 8 | 3 | 4 | 4 | 5 | 2 | 4 | 6 | 4 |
| 03/23/2017, Fair Grounds 10 | 1 | 2 | 3 | 6 | 1 | 5 | 3 | 9 |
| 03/05/2017, Fair Grounds 3 | 2 | 1 | 2 | 5 | 4 | 5 | 6 | 5 |
| 03/02/2017, Fair Grounds 4 | 3 | 1 | 1 | 4 | 4 | 1 | 5 | 2 |

FIG. 7

| Handicapping Factor | Representative Criteria Used to Evaluate the Applicability of Various Handicapping Factors for Predicting the Outcome of an Upcoming Race | | | | | |
|---|---|---|---|---|---|---|
| | % of Time the Top-Ranked Horse According to the Handicapping Factor Shown to the Left Finished in the Positions Indicated Below | | | Rankings of the Handicapping Factor Shown to the Left With Respect to their Ability To Predict the Outcomes Indicated Below | | |
| | % Win | % Placed | % Showed | Win | Placed | Showed |
| Best Lifetime Speed | 20 | 34.3 | 57.1 | 24 | 23 | 12 |
| Best Speed at This Track | 35.1 | 45.9 | 70.3 | 1 | 7 | 4 |
| Best Speed on Turf | 32.4 | 48.7 | 69.2 | 4 | 5 | 5 |
| Best Speed on Fast Track | 13.5 | 23.7 | 39.5 | 35 | 44 | 41 |
| Best Speed on Off Track | 8.8 | 23.5 | 41.2 | 48 | 45 | 37 |
| Best Speed at This Distance | 32.4 | 51.4 | 71.4 | 4 | 2 | 2 |
| Best Speed in Last 3 Races | 30 | 40 | 67.5 | 10 | 13 | 7 |
| Average Speed in Last 3 Races | 30 | 44.2 | 65.1 | 10 | 8 | 8 |
| Best 2 of Last 3 Average | 28.2 | 44.1 | 70.6 | 13 | 9 | 3 |
| Best Speed on All Weather | 13.5 | 34.6 | 57.7 | 35 | 22 | 11 |
| Last E1 Pace | 28.2 | 38.5 | 48.7 | 13 | 16 | 22 |
| Last E2 Pace | 33 | 42.5 | 60 | 3 | 10 | 9 |
| Last Turn Time | 8.8 | 20 | 45 | 48 | 50 | 28 |
| Average of Last 3 E1 Pace | 20 | 38.9 | 50 | 24 | 15 | 20 |
| Average of Last 3 E2 Pace | 28.2 | 35.3 | 52.9 | 13 | 20 | 15 |
| Average of Last 3 Turn Time | 8.8 | 28.6 | 54.3 | 48 | 33 | 14 |
| Last Late Pace | 15 | 22.5 | 40 | 33 | 47 | 39 |
| Average of Last 3 Late Pace | 10.8 | 24.3 | 45.9 | 44 | 42 | 27 |
| Average % Horses Beaten L5 | 13.5 | 27 | 48.6 | 35 | 37 | 23 |
| Average Earnings This Distance | 20 | 27.3 | 42.4 | 24 | 36 | 35 |
| Average Earnings This Track | 20 | 26.5 | 52.9 | 24 | 38 | 15 |
| Average Earnings on Turf | 32.4 | 55.9 | 67.6 | 4 | 1 | 6 |
| Avg. Earnings on All Weather | 10.8 | 24 | 44 | 44 | 43 | 32 |
| Average Earnings on Off Track | 10.8 | 32.4 | 44.1 | 44 | 26 | 31 |
| Average Lifetime Earnings | 32.4 | 47.1 | 50 | 4 | 6 | 20 |
| Trainer Win % Current Meet | 28.2 | 27.5 | 42.5 | 13 | 35 | 33 |
| Trainer Win % Current Year | 20 | 30 | 37.5 | 24 | 31 | 44 |
| Jockey Win % Current Year | 10.8 | 30.6 | 47.2 | 44 | 30 | 25 |

FIG. 9

Example of the Use of Some of the Data Shown in FIG. 7 to Compute a Weighting that is Applied to Each of A Player's Selected Handicapping Factors so as to Yield a Rank Ordering of the Horses in An Upcoming Race

| Selected Handicapping Factors | Handicapping Factor's Score | Reciprocal of the Handicapping Factor's Score | Handicapping Factor's Weighting |
|---|---|---|---|
| #1 - Best Speed at This Track | 5.844194276 | 0.171109986 | 0.18602991 |
| #2 - Best Speed on Turf | 5.046023699 | 0.198175843 | 0.21545577 |
| #3 - Best Speed at This Distance | 4.517565526 | 0.221358162 | 0.24065947 |
| #4 - Last E2 Pace | 6.035092506 | 0.165697543 | 0.18014553 |
| #5 - Average of Last 3 Purses | 6.117826722 | 0.163456738 | 0.17770933 |
| | | Sum = 0.919798271 | |

Notation:

"Score" = the Geometric Mean of the Criteria Rankings (Some of Which Are Shown In FIG. 7) Used to Evaluate the Applicability of Various Handicapping Factors for Predicting the Outcome of an Upcoming Race "Weighting" = the Reciprocal of the Handicapping Factor's Score as a Proportion of the Sum of the Selected Handicapping Factors

FIG. 10

Example of How the Horses For An Upcoming Race Are Rank-Ordered According To A Player's Selected Handicapping Factors

| Horse's # In The Upcoming Race | Horse's Score, Based On Prior Races, For Player's Selected Handicapping Factor (HF): | | | | | Horse's Mix Score | Horse's Mix Ranking In The Upcoming Race |
|---|---|---|---|---|---|---|---|
| | #1 | #2 | #3 | #4 | #5 | | |
| 1 | 92.1 | 93.3 | 94.4 | 91.6 | 15.6 | 88.8832 | 3 |
| 2 | 0 | 0 | 0 | 90.7 | 27.8 | 37.7785 | 8 |
| 3 | 0 | 100 | 98.9 | 95.3 | 70.4 | 93.9107 | 2 |
| 4 | 0 | 94.4 | 86.5 | 72 | 100 | 88.6297 | 4 |
| 5 | 78.7 | 85.6 | 83.1 | 0 | 30.3 | 69.5281 | 7 |
| 6 | 92.1 | 98.9 | 0 | 88.8 | 83.2 | 86.9940 | 5 |
| 7 | 100 | 98.9 | 100 | 100 | 17.5 | 98.4241 | 1 |
| 8 | 0 | 94.4 | 82 | 67.3 | 38.6 | 72.7251 | 6 |
| 9 | 0 | 0 | 0 | 72 | 36.8 | 26.5738 | 9 |
| | | | | | | | |
| Factor Weightings (See 5C) | 0.186 | 0.215 | 0.241 | 0.180 | 0.178 | | |

Notation:

Horse's "Score" = the Percentage that a Horse's Raw Number On a Specific Handicapping Factor is to the Raw Number of the Horse that has the Best Raw Number for the HF in Question (e.g., Assume the HF = "Lifetime Earnings" and that there are 3 horses in the race & that horses #1, #2 & #3 have respective earning of $11k, $9.9k and $6.5; then each's respective score on this factor is 11/11 = 100%, 9.9/11 = 90% and 6.5/11 = 59%)

Horse's "Mix Score" = a Form of a Weighted Geometric Mean of a Horse's Scores on the Player's Selected Handicapping Factors Horse's Mix Ranking In The Upcoming Race = a Ranking According to a Horse's Mix Score & wherein the Horse with the Highest Mix Score is Ranked 1st

FIG. 11

Assessment of the Effectiveness of such a "Horse's Mix Ranking (Based On A Player's Selected Handicapping Factor's & A Horse's Race History Under Similar Race Conditions)" Had It Been Applied to Predict the Outcomes In the Selected Set of 34 Prior Races Having Similar Race Conditions

| Horse's # In The Upcoming Race | Horse's Mix Ranking In The Upcoming Race | # of the 34 Prior Races Run With 9 Horses | # Wins | Win % | # Places | Place % | # Shows | Show % |
|---|---|---|---|---|---|---|---|---|
| 1 | 3 | 34 | 1 | 2.94 | 5 | 14.71 | 7 | 20.59 |
| 2 | 8 | 24 | 1 | 4.16 | 2 | 8.33 | 3 | 12.50 |
| 3 | 2 | 34 | 8 | 23.52 | 16 | 47.06 | 21 | 61.76 |
| 4 | 4 | 34 | 2 | 5.88 | 6 | 17.65 | 12 | 35.29 |
| 5 | 7 | 34 | 2 | 5.88 | 6 | 17.65 | 8 | 23.53 |
| 6 | 5 | 34 | 3 | 8.82 | 5 | 14.71 | 12 | 35.29 |
| 7 | 1 | 34 | 14 | 41.17 | 19 | 55.88 | 27 | 79.41 |
| 8 | 6 | 34 | 2 | 5.88 | 8 | 23.53 | 11 | 32.35 |
| 9 | 9 | 9 | 1 | 11.11 | 1 | 11.11 | 1 | 11.11 |
| | | | | | | | | |
| Sum | | | | 109.40 | | 105.31 | | 103.95 |

FIG. 12

Predictions For Various Outcomes For Each Horse In The Upcoming Race Based On The "Horse's Mix Ranking"

| Horse's # In The Upcoming Race | Horse's Mix Ranking In The Upcoming Race | Win % | Scaled Win % | Place % | Scaled Place % | Show % | Scaled Show % |
|---|---|---|---|---|---|---|---|
| 1 | 3 | 2.94 | 2.68 | 14.71 | 13.96 | 20.59 | 19.81 |
| 2 | 8 | 4.16 | 3.81 | 8.33 | 7.91 | 12.50 | 12.04 |
| 3 | 2 | 23.52 | 21.50 | 47.06 | 44.68 | 61.76 | 59.42 |
| 4 | 4 | 5.88 | 5.38 | 17.65 | 16.76 | 35.29 | 33.95 |
| 5 | 7 | 5.88 | 5.38 | 17.65 | 16.76 | 23.53 | 22.64 |
| 6 | 5 | 8.82 | 8.07 | 14.71 | 13.96 | 35.29 | 33.95 |
| 7 | 1 | 41.17 | 37.64 | 55.88 | 53.06 | 79.41 | 76.40 |
| 8 | 6 | 5.88 | 5.38 | 23.53 | 22.34 | 32.35 | 31.12 |
| 9 | 9 | 11.11 | 10.16 | 11.11 | 10.55 | 11.11 | 10.69 |
| | | | | | | | |
| Sum | | 109.40 | | 105.31 | | 103.95 | |
| | | | | | | | |

Notes:

Scaled Win % = The Win % divided by the sum of the Win %s.
Scaled Place % = The Place % divided by the sum of the Place %s and multiplied by 2
Scaled Show % = The Show % divided by the sum of the Show %s and multiplied by 3

For races with other than 9 contestants, we determine the various scaled percentage predictions according to the formulas:

$$\text{Scaled Win \%} = [(P/100 - 1/F)(\{F-2\}/F) + 1/F] \times 100$$
$$\text{Scaled Place \%} = [(P/100 - 2/F)(\{F-1.5\}/F) + 2/F] \times 100$$
$$\text{Scaled Show \%} = [(P/100 - 3/F)(\{F-1.4\}/F) + 3/F] \times 100$$

Where: P = Scaled % and F = Number of contestants in upcoming race

FIG. 15

| Recommended Wager Structure for Various Total Wagered Amounts On An Upcoming Race | | |
|---|---|---|
| **$2 Bet**<br>$2 Show on H1 | **$4 Bet**<br>$2 Win on H1<br>$2 Show H1 | **$6 Bet**<br>$2 Win on H1<br>$2 Show H1<br>$2 Show H2 |
| **$8 Bet**<br>$4 Win on H1<br>$2 Show H1<br>$2 Show H2 | **$10 Bet**<br>$4 Win on H1<br>$3 Show H1<br>$3 Show H2 | **$15 Bet**<br>$5 Win on H1<br>$5 Show H1<br>$5 Show H2 |
| **$20 Bet**<br>$6 Win on H1<br>$5 Show H1<br>$5 Show H2<br>$2 Exacta box (H1, H2) | **$25 Bet**<br>$7 Win on H1<br>$6 Show H1<br>$6 Show H2<br>$1 Exacta box (H1, H2, H3) | |
| **$50 Bet**<br>$9 Win on H1<br>$6 Show H1<br>$4 Show H2<br>$2 Exacta box (H1,H2)<br>$1 Exacta box (H1,H2,H3,H4)<br>$.5 Trifecta box (H1,H2,H3,H4)<br>$.1 Superfecta box (H1,H2,H3,H4)<br>$.5 Trifecta (H1,H2,H3)<br>$.1 Superfecta (H1,H2,H3,H4) | | |
| - where H1, H2, H3 and H4 are respectively the horses that are ranked the 1st, 2nd, 3rd and 4th highest according to their predicted probability of winning the upcoming race. | | |

$20 Bet

| | |
|---|---|
| $6 Win on #3 | $5 Show #7 |
| $5 Show #3 | $2 Exacta box (#3, #7) |

SKILLS-BASED, PARIMUTUEL SPORTS WAGERING ON MOBILE DEVICES

BACKGROUND OF THE INVENTION

1. Field of the Invention

The present invention generally relates to online, amusement devices. More specifically, the invention is directed to improved online methods and devices that provide for skill-based, sports wagering.

2. Description of the Related Art

Parimutuel wagering is a betting system wherein all the amounts of money wagered by a group of players/system users on each of the possible outcomes of a contest (e.g., which horse from among a field of horses will win a specific horse race) are placed together in a pool; taxes and the "house take" are removed (e.g., 14.25%) so as to yield a payoff amount that is shared among those players or system users who correctly picked the winner of the contest (i.e., winning players). By the use of a specialized machine, or totalisator/tote, which keeps track of all the bets, instantaneously computes the sum of the bets made on any one of the possible outcomes in a contest, and display this information, one is able to know when placing one's bet the various odds, depending on which outcome one bets, for winning some multiple of one's original bet—these odds often impact the wager that a player or system user will make and add to the excitement of such games.

Thus, for the example of a horse race, how much a player wins relative to one's bet depends on the payoff amount and the sum of the amounts that the other winning players also wagered. From knowing how much has been wagered on each horse in the race and thus the total amount wagered at the time of one placing his or her bet, one can get an idea of how much one might win if the percentages of money being wagered on the different horses stay the same until the start of the race when no further bets are accepted and the winning odds for the various horses are then determined.

Parimutuel betting differs from "fixed-odds" betting in that the final payout is not determined until the pool is closed—in "fixed-odds" betting, the odds are often being offered by a bookmaker who is responsible for making the required payouts to the winning users from the monies that the bookmaker presumably collects from those users who placed non-winning bets on the same race with the bookmaker. If these monies are insufficient to make the required wining payouts, the bookmaker is expected to make up the balance of any needed funds from the bookmaker's own surplus funds.

Parimutuel wagering is usually state-regulated by the establishment of a body of rules by which those entities who provide parimutuel wagering must operate. Thus, parimutuel wagering is offered in many places where "fixed-odds" betting or gambling is otherwise illegal. The state regulatory agencies for parimutuel wagering usually belong to the Association of Racing Commissioners International (ARCI), which is their rule-making, umbrella organization in North America and parts of the Caribbean for parimutuel wagering on professional horse and greyhound racing.

From its beginnings in the 1930's, parimutuel wagering evolved as part of the larger wagering, entertainment industry by developing a wide assortment of innovations, including: (1) cash-accepting, wagering terminals or machines, (2) self-service wagering machines, (3) advanced deposit wagering—first using the telephone and eventually using the internet and online mobile devices, (4) interstate simulcast wagering in the late 1970's, (5) intrastate simulcast wagering in the early 1980's, (6) new types of wagering opportunities, including wagering on previously-run, order of finish contests as part of what has become known as "instant wagering" or "instant racing," or, for the horse racing industry, "historic horse racing" (HHR), and (7) online, mobile wagering.

Online, mobile wagering involves a player signing up and establishing a player's secure account on one of the many websites that provide online, sports wagering (e.g., see Xpressbet.com) by completing the website's registration process and making an initial deposit to fund the player's account. A player is then provided to with the pertinent data that is relevant to an upcoming race (e.g., identity of the horses and the jockeys in the race, appropriate background information on them, current racetrack conditions, the listed odds (for pari-mutuel wagering, based on the status of the current wagering on the race) on any one of the various horses actually winning the race) at any one of a multitude of racetracks.

The information relevant to an upcoming race is provided so as to aid the player in deciding which horse in the field the player thinks will finish in any specific position at the end of the race (i.e., handicapping the race). There also exists various types of software that will assist a player in handicapping the races on which the player is considering placing a wager (e.g., see Betmix.com).

After a player handicaps a race, he or she then places his or her wager or wagers that the outcome of a designated race will be one or more selected horses finishing in one or more order-of-finish places. Depending on the video capability of a player's mobile device, the player can watch the race live or on a video replay to see which horse or horses finish in specific order-of-finish places.

Many of the methods and apparatus or systems associated with sports wagering have been patent protected, see, e.g., U.S. Pat. Nos. 2,182,875, 2,179,698, 5,411,258, 5,830,068, 5,846,132, 6,383,074, 6,358,150, 6,450,887, 6,736,725, 8,636,571, 8,814,700, 9,047,737, 9,053,608, 9,437,078, 9,443,392 and 9,747,748.

Despite the mature nature of sports wagering, there still exists the need and opportunity to further improve it, especially its online, mobile form, so as to enable it to provide its players with greater levels of excitement and entertainment while also complying with the established rules for sports wagering, especially on horse racing.

For example, there is a huge learning curve for a novice player to master before he or she can actually increase his or her chances of being able to predict the winner of an upcoming horse race. One needs to know: (a) a huge amount of background information on the horses and their jockeys and how to wisely use it to try to predict the winner of an upcoming race (referred to herein as handicapping a race), (b) what types of bets are available and which of these have the best odds of being winners considering the background information of the upcoming race (referred to herein as having a wagering strategy), and (c) what amounts for one's various wagers or bets has the greatest likelihood of allowing a player to make money on his or her wagers (referred to herein as employing a money management strategy).

Even for very experienced players, there is still always the immense challenge of how to most wisely use the background or handicapping information available to a player and what wagering and money management strategies to employ to increase a player's enjoyment of wagering on horse racing. Current mobile, sports wagering platforms offer only a limited amount of information on how to most wisely use the available handicapping information and almost no information on how to most wisely use various wagering or money management strategies.

Additionally, current mobile, sports wagering platforms usually take, even for the most experienced players, an enormous amount of time to use which can greatly detract from one's actual wagering experience. There is a need for an improved, skill-based, sports wagering system that can reduce the whole race handicapping and wagering process to a minimal amount of time, e.g., five minutes.

The present invention seeks to address and provide various remedies to the above-identified problems that currently present barriers to a player's maximum enjoyment of online wagering.

BRIEF DESCRIPTION OF THE DRAWINGS

FIGS. 3A-3D show examples of some of the possible "login screens" and "account creation screens" that the present invention is configured to provide on the screen of the mobile device of a player that is using the present invention.

FIG. 6 shows an example of some of the data that the present invention uses in evaluating the applicability or effectiveness of various possible handicapping factors for their usefulness in predicting the outcome of an upcoming race having specific race conditions. Shown are the finishing position of the top-ranked horse according to various handicapping factor in each of the races from a group of prior races having race conditions similar to that of the upcoming race.

FIG. 7 shows an example of some of the criteria that the present invention uses to evaluate the applicability of various possible handicapping factors for predicting the outcome of an upcoming race. Some of these criteria are seen to be a handicapping factor's ranking according to the percentage of time the top-ranked horse according to the handicapping factor actually won, placed or shown and its winning, placing or showing ROIs, plus its Accuracy.

FIG. 9 show an example of how the present invention uses the results shown in FIG. 7 to compute a weighting that is applied to each of the player's selected handicapping factor so as to ultimately yield a rank ordering of the horses in the upcoming race and predictions for the various outcomes of the race.

FIG. 10 shows, for an upcoming race, its nine participants and some of the data that goes into assessing and eventually rank-ordering or handicapping these participants in order to predict the various outcomes that can occur in the upcoming race.

FIG. 11 shows an assessment of the effectiveness of the present invention's computation of a "Horse's Mix Ranking" for an upcoming race by evaluating the accuracy of such a ranking in predict the outcomes in a selected set of 34 prior races that had similar race conditions.

FIG. 12 shows how the present invention's computation of a "Horse's Mix Ranking" can be used to predict the race outcomes for each of the horses in an upcoming race.

FIG. 15 is an example of a "Recommended Wagering Strategy" screenshot that the present invention is configured to provide on the screen of the mobile device of a player that is using the present invention.

DESCRIPTION OF THE PREFERRED EMBODIMENT

Figure 1:
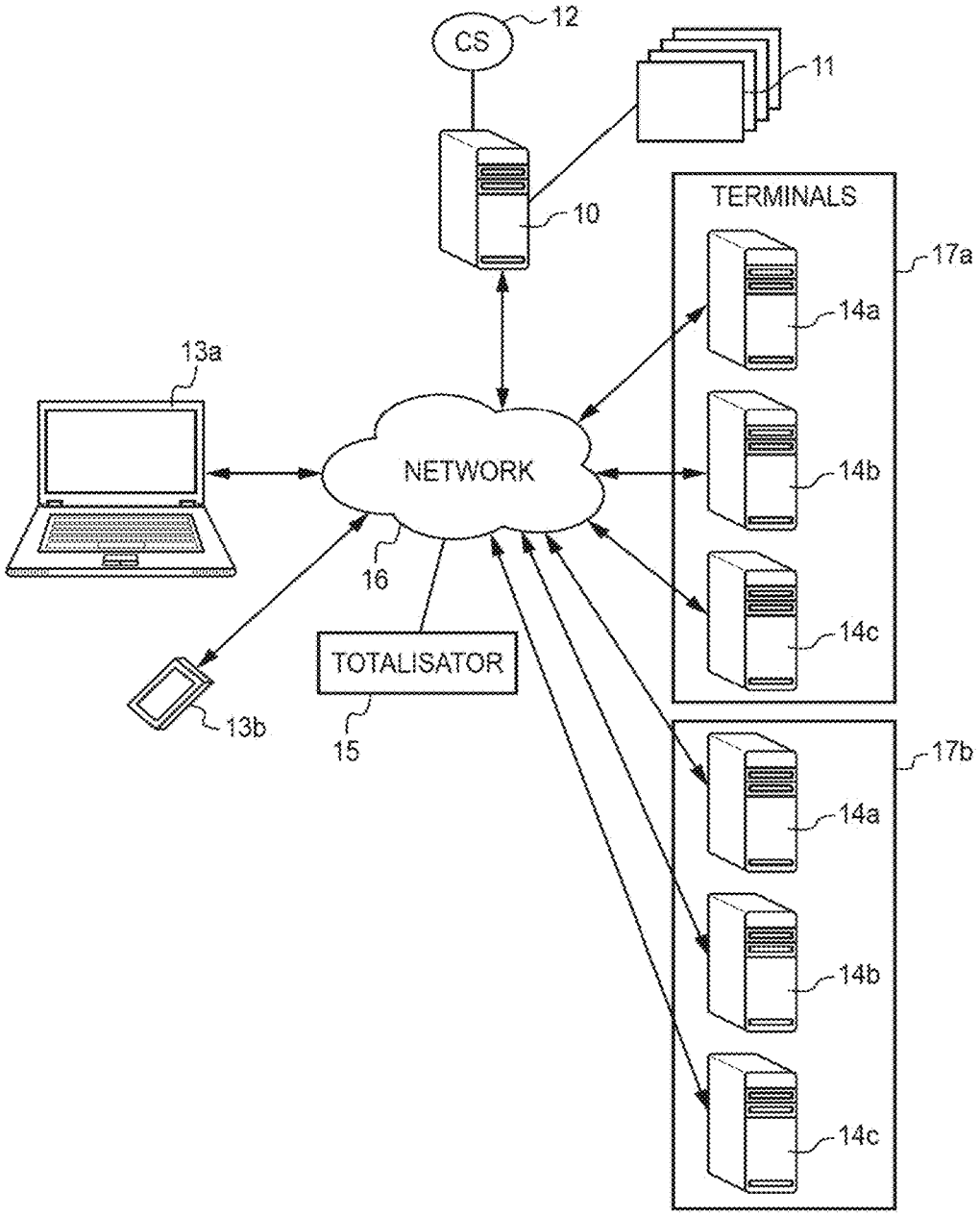
FIG. 1 is a block diagram that illustrates the general architecture of an improved sports wagering system that enables one or more players or users to make various types of wagers on any of a number of multi-contestant, order-of-finish contests (OOFCs) that may be occurring at any one of a multitude of locations or facilities.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Shown in FIG. 1 is a block diagram that illustrates the general architecture of an improved sports wagering system, according to the present invention, that enables one or more players or users to make various types of wagers (e.g., Win, Place, Show, Exacta, Exacta Box, Trifecta, Trifecta Box, Superfecta, Superfecta Box, Quinella) on any of a number of races or multi-contestant, order-of-finish contests (OOFCs) that may be occurring at multiple locations or facilities. Such a system includes the server 10 of an entity that provides online, mobile, wagering and its database 11 and control software 12 that allows this server 10 and the mobile devices 13, terminals 14 and, a totalisator 15 with which the server communicates to accept the players' various wagered amounts, etc.

To do this, the server of the present invention connects over a network 16 (e.g., the Internet or other network) to its targeted players who are those with mobile devices (laptop computer 13*a*, smart phone 13*b*, etc. with a touch-screen interface) and wish to place a wager via a web-browser-enabled 14*c* wagering terminal that is connected to a totalisator 15.

Also connected to this network are other players who are gathered to watch OOFCs and place wagers at a number of facilities (host 17*a*-where the actual OOFC is occurring, and guest 17*b*—an off-site location) via the facilities' various types of wagering terminals (e.g., teller 14*a*, self-service 14*b*, web-browser enabled (i.e., it connects & communicates over the network 16) 14*c*).

A totalisator is a key element of any wagering system as it performs a wide assortment of key tasks, including: (a) receiving and validating each individual wager placed on a race or OOFC, totaling all the wagers into pools, continually computing and announcing to interested players the odds of each of the contestants winning a specific OOFC based on the sum of the wagers placed at each instant in time before the beginning of the OOFC, calculating, for pari-mutuel wagering, the payout of each wager based on the outcome of the contest, providing operational management of the receipt and payment for each wager placed, and tracking winning wagers and applying appropriate tax regulations to the winnings; (b) report and presentation generation: the storage of all the racing and wagering information, the selection, filtering and rendering of reports used in the conduct, operations, management and regulation of wagering, (c) operation of various tasks associated with a OOFC: entering and managing race-relevant, handicapping information for each contestant so that a player can view and consider this information before placing a wager, enabling & managing wagering for a particular OOFC, monitoring and controlling the terminals and other devices (e.g., video recording) at the host facility; and recording the outcomes of OOFCs; and (d) operational support services: configuring the underlying databases, monitoring all incoming and outgoing communication links, pool transfers, and information streams, configuring and managing the distributions applicable to each pool available for a wager on a particular OOFC, and monitoring and managing access to the totalisator by the facilities and players.

Figure 2:
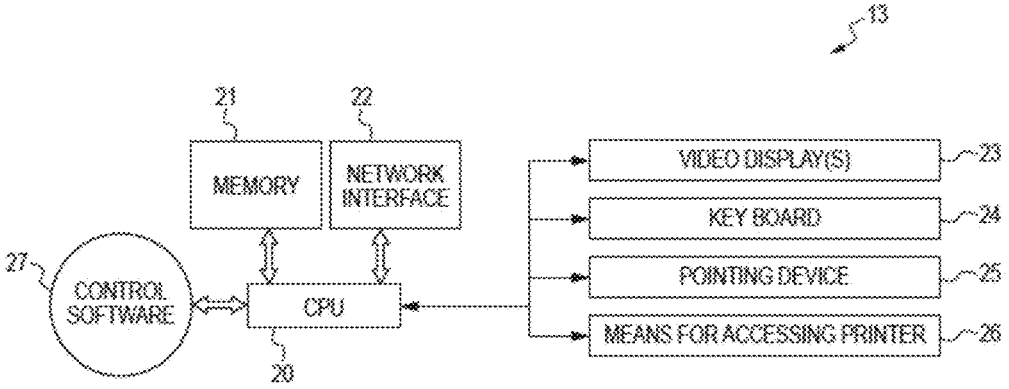
FIG. 2 is a block diagram that illustrates the general architecture of the types of mobile devices that are intended to be used with the present invention.
Figure 3A:
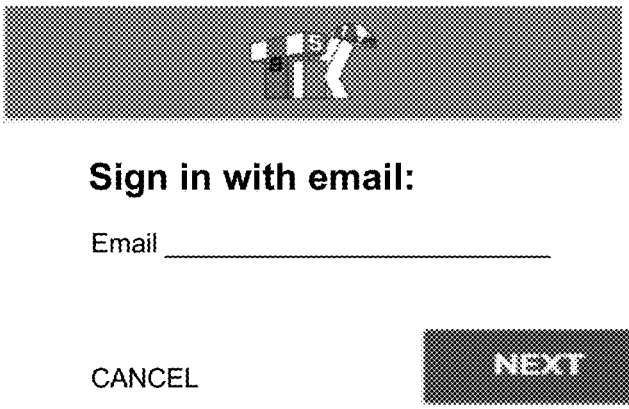
Figure 3B:
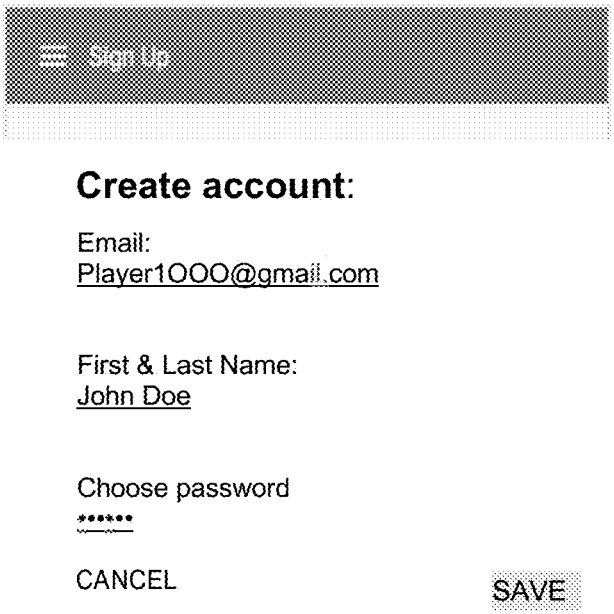

With the present invention seeking to increase the enjoyment of sports wagering for those targeted players or users who primarily utilize mobile devices but may also use a desktop computer and hereinafter we use the term "mobile device" to include both of these options, it is useful to describe in some detail the types of mobile devices that are intended to be used with the present invention. These typically consist of a web-browser enabled, desktop, laptop or tablet computer 13*a*, a smart phone 13*b* or other smart device that may include: a CPU 20, memory 21, a network interface 22, video displays 23 for viewing by a player, a key board 24 and pointing device 25 to allow a player to interact with a networked terminal 14*c*, possibly a means for accessing a printer 26 that allows a player to produce a hardcopy of any reports provided by the system, and control software or a downloadable app 27 that yields screen shots on the device and controls the functioning of the mobile device as it relates to its interactions with the server 10 of the present invention and the rest of this improved wagering system. See FIG. 2.

The mobile device's hardware and its control software assist in enabling a player or user to work with the server of the present invention to: (a) register to become a user of the present invention, (b) establish a player's account from which monies will be drawn to cover the cost of the various wagers placed by the player, (c) fund one's account through the use of one of the many forms of electronic fund transfers, whether bank account based or credit card based, (d) select, from among a multitude of races occurring at various race tracks around the world, one or more of such upcoming races on which to wager, (e) access and use information on various handicapping factors which can help a player better predict the outcome of the upcoming race, (f) provide the improvement of accessing and using the unique analysis of the present invention to help identify which of these many handicapping factors is likely to be the most accurate or applicable to predicting the outcome of the upcoming race, (g) using this analysis, select the handicapping factors that the player wishes to use to handicap the upcoming race, (h) access and use the present invention's improvement consisting of the application of these selected handicapping factors to the contestants in the upcoming race so as to yield the present invention's predictions for the outcome of the upcoming race, (i) access and use as much as the player desires of the present invention's improvement consisting of the guidance for a combined wagering and money management strategies that are designed to maximize the player's enjoyment of this wagering experience, (j) place all manner of wagers on any or all of the available races, and/or follow any or all of the combined wagering and money management strategies provided by the present invention, (k) select and receive a video stream of a selected race live or as a replay, and (l) conduct various administrative functions for the player's account.

The server's control software 11 is configured such that it facilitates all of the various functions and operations of the players' mobile devices while also keeping track of all of the register players and their accounts, plus all the information pertaining to upcoming and past races or OOFCs and the background data on the contestants participating in these OOFCs.

The present invention is ideally configured in such a manner as to build on and complement electronic payment technology, both today and into the future. Because of this commitment, its preferred embodiment is configured to run on a "cloud" server platform for maximum portability. The present invention requires that minimal local software be downloaded or installed. This approach simplifies the usually involved software application (app) certification process. The interface of the present invention is simply a website which its users visit. Local software is only used to enable access to local technology on the user device. The software of the present invention is configured so as to perform on Windows and Apple laptops using to current browsers. Smartphone and tablet compatibility is also provided—Apple iOS, Android, and Windows are fully supported.

The software of the present invention is also configured so that its mobile interface operates with the look and feel of a local application, i.e., launched from an icon without starting the browser, even though it will run through the browser.

As a hybrid mobile application (i.e., cloud-based functionality which also incorporates native device utility), the present invention is further configured to access and utilize the local technology available on mobile devices, in particular cameras, near field communication (NFC) "swipe" sensors and readers.

To better acquaint one with the software requirements and capabilities of the present invention, shown in this application's FIGS. are various user interface screen illustrations or screenshots that the control software of the present invention makes appear on the display of a player's mobile device. These screenshots could be in a webpage or smart phone or tablet format, but are shown here in a smart phone format and in English. However, since the present invention is an international, multi-language, multi-currency invention, the native language environmental setting on each mobile device will be used to automatically select the language presented to the user. Date and currency formats will also match user preferences.

FIGS. 3A-3D show examples of possible "login screens" and "account creation screens" for the present invention. These screens are configured so as to: (a) allow a player to register in order to gain access to use the present invention on the player's mobile device, and (b) setup a financial account that will provide from a financial institution of the player's choice the funds for the various wagers that a player elects to make.

Figure 4:
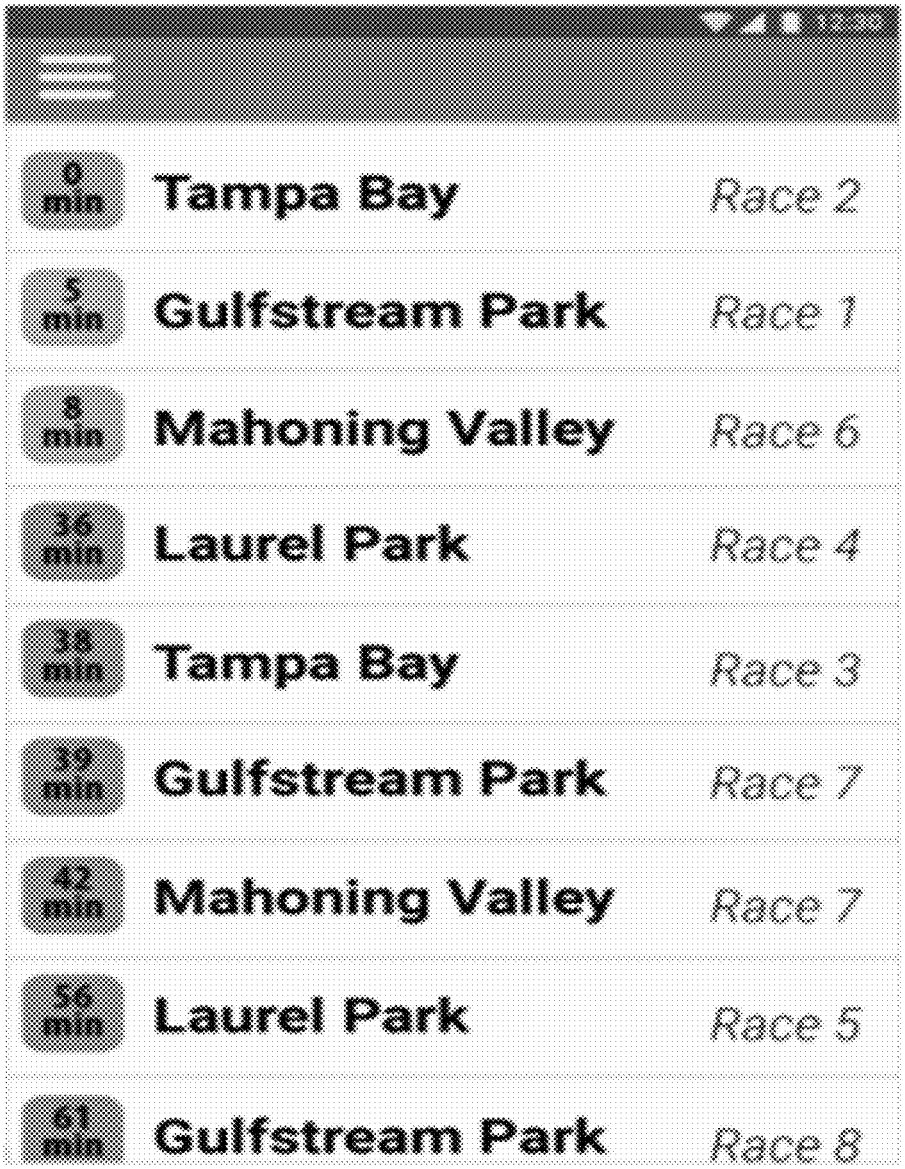
FIG. 4 is an example of a "Racetracks With Available Races" screenshot that the present invention is configured to provide on the screen of the mobile device of a player that is using the present invention.

After these administrative requirements are completed, a player can begin the actual task of handicapping and placing wagers on upcoming races. The first step in this process will usually be to make a selection of the upcoming race on which the player wants to wager. To facilitate this selection, a screenshot similar to that shown in FIG. 4 will often appear on the mobile device of a player that utilizes the present invention. This screenshot was created by configuring the control software 12 that runs on the server 10 of the present invention so as to display a list of all upcoming races, which are soon to be held at any one of a number of multiple tracks or venues with which the present invention is communicating, on which a player can wager. These are sorted in ascending order in this screenshot by the minutes until a race's post time (i.e., the time at which the contestants in the race are required to be at the starting post).

After selecting an upcoming race on which to wager, a player utilizing the present invention is presented with the opportunity to handicap the upcoming race. It is with this activity where the present invention makes its greatest contributions.

This handicapping involves a player being presented with a list of numerous handicapping factors from which he or she can choose to use some or all of them to help the player handicap or predict the winner, etc. of an upcoming race. See FIG. 5 which shows another screenshot, that is created by configuring the software that runs on the server of the present invention, which shows on a player's mobile device a partial list of some of these possible handicapping factors that a player may use when handicapping an upcoming race.

For illustrative purposes, shown below are some of the up to 52 handicapping factors that the present invention defines and allows a player to use to enhance his or her handicapping and wagering experiences:

Best Speed Fast Track
Best Speed Last 3
Jockey current meet
Late Last Pace
Trainer Current Meet
Lifetime Earnings
Trainer/Jockey Combo For the sake of brevity, we'll postpone until later in this specification a full listing of the present invention's handicapping factors and their definitions. However, it should be recognized that various embodiments of the present invention can utilize a greater or lesser number than 52 of these handicapping factors.

To help a player use and interpret the usefulness of these handicapping factors, the server 10 of the present invention includes and maintains a huge database of past race results and background information (i.e., history of past performances) on the horses, jockeys, trainers, etc. that are continually updated so as to allow the various horses who might be racing in an upcoming race to be currently and timely assessed and rank ordered according to each of these handicapping factors.

Figure 5:
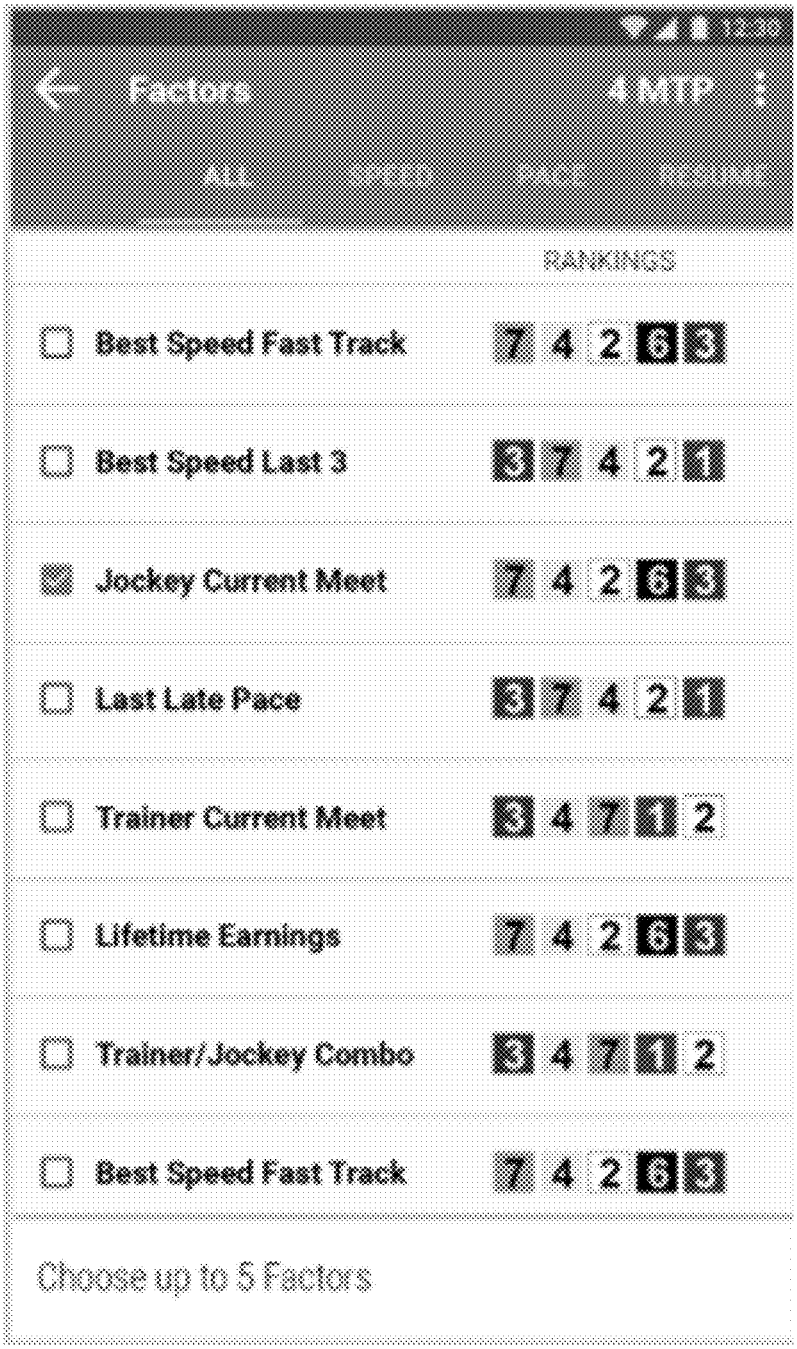
FIG. 5 is an example of a "Available Handicapping Factors" screenshot that the present invention is configured to provide on the screen of the mobile device of a player that is using the present invention. This screenshot also shows the rankings of the horses in the upcoming race according to each of these handicapping factors.

An example of this rank ordering is shown on the right-hand side of FIG. 5 where there appears in the row with the name of one of the handicapping factors a "Top 5 rank ordered listing per the named handicapping factor" of the numbers of the contestants or horses in the upcoming race.

To understand how the control software 12 of the present invention is configured to provide this information, let's consider a specific one of these handicapping factors, e.g., the "BEST SPEED FAST TRACK" for each of the horses that are entered in an upcoming race. The present invention has defined this handicapping factor as "for a specific horse, a number (e.g., a Beyer Speed Figure) that represents the highest speed figure earned by the horse when running on a fast dirt track."

Such information is readily available from the database 11 of the present invention for past race results for each of the horses in an upcoming race. Assume that the upcoming race will have eight starters that will be numbered 1-8 and that the speed numbers (with the highest number representing the fastest horse) for these horses are respectively: 1-85, 2-96, 3-88, 4-102, 5-86, 6-92, 7-110, and 8-80. Thus, we see on the right-hand side of FIG. 5 that the present invention has searched its databases to determine that the top ranked horse according to this handicapping factor is #7, followed by #4, #2, #6, etc.

As helpful as this information might seem to be to the task of handicapping an upcoming race, an aspiring player soon learns that it is still an enormous task to try to intelligently and efficiently use this information to handicap an upcoming race. For example, which combination of these handicapping factors is likely to be the most accurate in predicting the result of an upcoming race? How does one go about evaluating and logically choosing which of these or other handicapping factors to use in picking a horse on which to wager in an upcoming race and which of many types of available wagers has the highest probability of being a winning wager?

The great difficulty and effort required by such a data and skill-based, handicapping task is why a large percentage of players don't even bother to undertake this task and consequently probably make fewer winning wagers than they could have achieved had they made the handicapping effort. Better and more efficient, accurate and easily-used, handicapping methods are needed to increase players enjoyment of sports wagering.

The opportunity to provide better handicapping methods are especially pertinent to mobile devices since they seem to be becoming for almost all players their ever-present and preferred communication devices. This is because these devices can use their rapid data streaming and video capabilities to potentially receive and make use of the handicapping wisdom derived from racing experts who utilize novel, and proven-to-be-successful, computer algorithms to analyze for handicapping purposes the vast amounts of background data applicable to upcoming races.

To help a player to evaluate and decide which of these or other handicapping factors might be most applicability to an upcoming race, the control software 12 of the present invention is configured so as to present the player with its own unique method of evaluating the potential usefulness of these handicapping factors. This evaluation begins by noting that the applicability of each of these handicapping factors will be a function of the nature of the upcoming race for which these handicapping factors are possibly to be used.

For example, a horse's assessment against the "Best Speed Turf" and "Best Speed Fast Track" handicapping factors are likely to be irrelevant when it's known that the upcoming race is going to be contested over a muddy and sloppy, dirt track.

To evaluate the applicability of these handicapping factors for an upcoming race, the control software 12 of the present invention is configured so as to begin this evaluation by taking into consideration the conditions relevant to the upcoming race. Examples of the conditions that might be included in this evaluation include the following: (1) the specific track on which the race is to be contested, (2) distance to-be-raced, (3) type of surface on which the race is-to-be run, (4) number of starters (e.g., group 1: less than or equal to 6 starters; group 2: 7-9 starters, and group 3: 10 or more starters), and (5) class of the race (e.g., Maiden, Claiming, Allowance, Stakes and Graded Stakes).

The control software 12 of the present invention is further configured so as to then go about identifying from its vast database of past races, etc. a select number of prior similar races (with respect to the track on which the race was run, the distance of the race, the condition of the surface on which the race was run and whether it was wet or dry, the number of starters in the race, the class of the race, the time duration between when the prior race was run and the upcoming race, etc.) against which to assess the past success of each of these handicapping factors at predicting the winners, etc. in these prior, similar races.

The search criteria used by the control software 12 of the present invention for finding races that are similar to an upcoming race include: (1) whether run on the same track, (2) distance raced, (3) type of surface on which the race was run, (4) number of starters (e.g., group 1: less than or equal to 6 starters; group 2: 7-9 starters, and group 3: 10 or more starters), (5) class of racing, and (6) duration between when the prior race was run and the upcoming race (e.g., within the past two years). Using these criteria, a search of prior race results is made so to try to identify a specified number, for example, twenty or more, of such prior, similar races.

If fewer than the specified number of similar races are identified in this initial search, a second search is performed and the criteria is broadened by, for example, not limiting the identified similar races to only those held in the last two years. This broadening (e.g., drop the track criteria) and search effort continues until at least a specified number of prior, similar races are identified.

Once the desired group of similar races is identified, the control software 12 of the present invention is configured so that it provides a unique handicapping factor applicability evaluation (using the results of identified, prior similar races) procedure that seeks to identify which among these many handicapping factors is most likely to have the greatest accuracy in predicting the result of an upcoming race.

FIG. 6 begins to show an example of how the present invention performs this handicapping factor applicability evaluation. The first column or the one on the far left of this FIG. shows a number of the 34 prior races that were found to have been conducted under similar race conditions (i.e., races for which the following are the same: the track, distance raced, type of surface, number of starters and class of racing) to that of the upcoming race on which the player wishes to place a wager (e.g., Dec. 31, 2017, race #4 at Fair Grounds). The $2^{nd}$ column shows the finishing position of the top-ranked horse in each of these prior races according to the handicapping factor entitled "Best Lifetime Speed (see definition is the list at the end of this specification)." The other columns to the right show similar information for other handicapping factors. This data allows one to compute the percentage of time that a top-ranked horse according to any of these handicapping factors actually won, placed or showed, etc. in this group of prior races having similar race conditions. Then, these various handicapping factors can, based on these percentages, be ranked ordered as to their effectiveness at predicting various race results (e.g., placing $1^{st}$ $2^{nd}$ or $3^{rd}$, etc.) for this group of prior races that had similar race conditions to the upcoming race.

See FIG. 7 for examples of such percentages and rankings that a top-ranked horse according to a large group of such handicapping factors actually won, placed or showed, etc. in this group of prior races having similar race conditions. According to the present invention, its handicapping factor applicability evaluation procedures can take many forms as long as they are based on using the results of identified, prior races that are similar to the upcoming race for which it is desired to pick the winner, etc.

Figure 8:
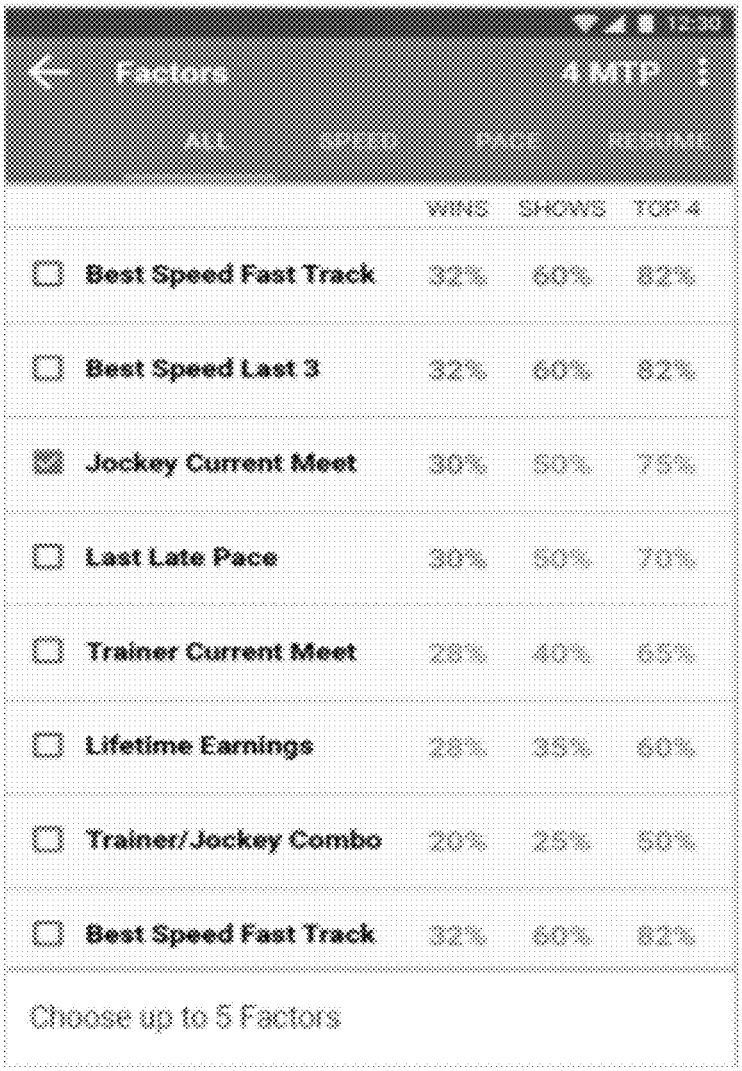
FIG. 8 is an example of a "Handicapping Factor, Applicability Evaluation Results" screenshot that the present invention is configured to provide on the screen of the mobile device of a player that is using the present invention. This screenshot shows, for each of these handicapping factors and a group of prior races that has similar race conditions as that of the upcoming race, the percentage of time that the top ranked horse according to a particular handicapping factor finished so as to either win, show or place in the top 4 for this group of prior races.

The "applicability results" of the present invention's handicapping factor applicability evaluation can be communicated to the mobile device of a player in many ways. FIG. 8 shows one of these ways. It is a display of a screenshot that includes the handicapping factors previously seen in FIG. 5 and to the right of these are three columns, each of which gives an example of an "applicability result (examples of which were previously seen in FIG. 7)," of the present invention's handicapping factor applicability evaluation, that a player can use to decide whether he or she wants to use the particular handicapping factor for handicapping the upcoming race.

For the display shown in FIG. 8, these "applicability results" columns are entitled WINS, SHOWS and TOP 4. They are defined as: WINS=the percentage of time that the contestant that was top ranked by a specific handicapping factor actually won one of the races from the group of identified similar races; SHOWS=the percentage of time that the contestant that was top ranked by a specific handicapping factor actually showed (i.e., finished $1^{st}$, $2^{nd}$ or $3^{rd}$) in one of the races from the group of identified similar races;

and TOP 4=the percentage of time that one of the top 4 ranked contestants by a specific handicapping factor actually won one of the races from the group of identified similar races.

Other notable evaluation "applicability results" that are defined and used by the present invention include: PLACE=the percentage of time that the contestant that was top ranked by a specific handicapping factor actually placed (i.e., finished $1^{st}$ or $2^{nd}$) in one of the races from the group of identified similar races; ACCURACY=a computed, relative score that describes how often the top ranked horse finishes $1^{st}$ the $2^{nd}$ ranked horse finishes $2^{nd}$, the $3^{rd}$ ranked horse finished $3^{rd}$ and the $4^{th}$ ranked horse finishes $4^{th}$ (a perfect accuracy score would be 100; a factors accuracy score is defined so as to be impacted negatively by races in which the top ranked horses do not run in any of the positions $1^{st}$-$4^{th}$); WIN PROFIT=the return on investment (ROI) of betting $2 to win on the top ranked horse within the factor for every race in the sample.

The fact that present invention has chosen to present the "applicability results" of its handicapping factor applicability evaluation in terms the three numbers shown in FIG. 8 (i.e., % WINS, % SHOWS and % TOP 4) rather than a single number, is significant and the reason behind this choice needs to be understood as it is indicative of another primary objective of the present invention.

The three "applicability results" of % WINS, % SHOWS and % TOP 4 are given because of the present invention's realization that a player probably should be considering making any one of a variety of different types of wagers as part of an overall wagering or betting strategy that the player is employing. Thus, this evaluation's "applicability results" have been formatted so that they will be applicable to a number of the variety of different types of wagers that a player may be considering. Consequently, the % WINS column of "applicability results" is probably most applicable to those players who are considering making a Win wager, the % SHOWS column of "applicability results" is probably most applicable to those players who are considering making a Show wager, and the % TOP 4 column of "applicability results" is probably most applicable to those players who are considering making a more exotic wager (e.g., a quinella).

By presenting its handicapping factor "applicability results" in a variety of ways depending upon the type of wager a player may be considering making (i.e., presenting "wager-oriented, applicability results"), the present invention is seeking to specifically aid those players who are following a well-considered and formulated wagering strategy. Ideally, a player will use the information provided by these "applicability results" to decide whether he or she wants to use a particular handicapping factor for handicapping the particular type of wager that the player is considering making on an upcoming race.

Again, it should be recognized that there are many ways to define and compute these "wager-oriented, handicapping factor applicability results" and many of these will come within the scope of the present invention, especially those that involve using a select number of prior similar races (with respect to track, distance, surface, starters, class, and duration between when the prior race was run and the upcoming race) to compute such "wager-oriented, applicability results."

However, even with such data-based "wager-oriented, applicability results" that can be used to decide which of the handicapping factors one should use in handicapping an upcoming "similar" type of race, the handicapping factor selection task is still a daunting task.

In the development of the present invention, many different methods for selecting these handicapping factors were evaluated (e.g., what is the impact of limiting one's number of selected factors to 3, 5, 7, 10 or 20 on the resulting accuracy of the predicted race winner, etc?) using the earlier identified group of similar prior races. It was found that there was diminishing improvement in the accuracy of the predicted winner when one was using more than 5 handicapping factors.

It was this revelation that led the control software of the present invention to be configured so that it asks a player or user to pick or select only up to five of the present invention's handicapping factors to be used in handicapping an upcoming race. For example, assume that a player is interested in placing a wager on a certain horse to win in an upcoming race based our applicability evaluation that identified the most effective of the available handicapping factors in predicting the winning horses in the group of prior races having similar racing conditions, and assume that data, similar to that in FIG. 7, shows that the top ranked "win" handicapping factors are:

| Handicapping Factor | Rank |
|---|---|
| Best Speed @ This Track | 1 |
| Average of Last 3 Purses | 1 |
| Last E2 Pace | 3 |
| Best Speed On Turf | 4 |
| Best Speed At This Distance | 4 |
| Average Earnings On Turf | 4 |
| Average Lifetime Earnings | 4 |
| Average of Last 3 Race Classes | 4 |

Thus, it would not be surprising to find that in this situation a player had chosen to use the following five handicapping factors to handicap the upcoming race:

Best Speed @ This Track
Average of Last 3 Purses
Last E2 Pace
Best Speed On Turf
Best Speed At This Distance Assuming that this is the case, let's now consider how the control software of the present invention is configured to apply the above selected handicapping factors to the contestants or horses in an upcoming race so as to handicap and/or predict all manner of outcomes for the upcoming race.

Let's further assume that the handicapping factor applicability evaluation results or "applicability results" which the present invention used to evaluate the effectiveness of the available handicapping factors were the handicapping factor's seven, individual rankings according to the percentage of time the top-ranked horse (according to the handicapping factor) actually won, placed or showed and its winning, placing or showing ROIs, plus its Accuracy.

The present invention uses such results to compute a weighting that is applied to each of the player's selected five or fewer handicapping factor so as to ultimately yield a rank ordering of the horses in the upcoming race. FIG. 9 demonstrates how these weightings are computed. Such a calculation begins by determining a "score" for each of the selected handicapping factors. This score for each handicapping factor is defined to be the geometric mean of its seven, individual rankings according to the seven criteria that were used in the "applicability evaluation" of the available handicapping factors. Thus, if a handicapping factor has rankings of r1, r2, r3, r4, r5, r6 and r7, its score will be the geometric mean of these seven criteria rankings, i.e., $(r1 \times r2 \times r3 \times r4 \times r5 \times r6 \times r7)^{1/7}$. The inverse or reciprocal of each of these five scores are summed, and the percentage that each of these inverses is to their sum is defined as the weighting for the handicapping factor. See FIG. 9.

Next, each of the horses in an upcoming race is assessed and eventually rank-ordered using the above-calculated weightings applied to each of the player's five selected handicapping factors. See FIG. 10 where it is identified that the upcoming race will have nine participants and the data that goes into computing these rankings are shown.

For each of the selected handicapping factors, a score (on a scale of 0 to 100) is assigned to each of the contestants or horses in an upcoming race based on the contestant's prior race results with respect to the handicapping factor being scored. For example, assume the handicapping factor (HF) of interest is "Lifetime Earnings" and that there are only 3 horses in the race & that horses #1, #2 & #3 have respective earning of $11 k, $9.9 k and $6.5; then each's respective score on this factor is 11/11=100%, 9.9/11=90% and 6.5/11=59%.

These scores with respect to the selected handicapping factors and weightings for the handicapping factors are then combined (i.e., using a type of weighted, geometric mean) to yield what is referred to as a horse's "mixed score" and these are used to rank-order or handicap the horses for the upcoming race. See FIG. 10.

To predict the various outcomes for the upcoming race using such computed "Horse's Mixed Score" numbers and the consequent "Horse's Mixed Score Rankings," the present invention uses this same sort of analysis and applies it to the contestants in each of the group of selected prior races that were used to evaluate the applicability of the various handicapping factors in order to determine how each of the horses in each of these races performed relative to the "Horse's Mixed Score Ranking." The results of such an analysis is shown in FIG. 11.

These results show the horse having the top "Mixed Score Ranking" going into each of these races eventually ended up winning, placing or showing in these races the following respective percentages of time: 41%, 56% and 79%.

We then make the assumption that such similar percentage for other types of potential outcomes will be applicable to the upcoming race which has nine participants and is being run under similar race conditions. See FIG. 12.

Shown below are representative equations that are used to calculate some of the quantities defined above and used in handicapping an upcoming race:

The formula used to assign the weightings to each handicapping factor is:

$$w_f = \left(s_f\left(\sum_{f=1}^{n} s_f^{-1}\right)\right)^{-1}$$

where s f is the factor score.

As previously noted, each horse in the race has a score (0 to 100) for each factor. When considering n factors in a race with h horses, a horse has the scores $$S_h=[s_1,s_2, \ldots ,s_n].$$

Let the inverted scores *Ih* be given by $$I_h=[i_1,i_2, \ldots ,i_n].$$

such that $$i_n=101-s_n$$

Let the weights assigned to all *n* factors be $$W_f=[w_1,w_2, \ldots ,w_n].$$

A horse's final or mixed score is given by:

$$F_h(S_h, W_f) = 101 - e^{\left(\frac{w_f \cdot \log i_h}{\sum_1^n w_n}\right)}$$

The final scores for each horse in the race of interest is used to rank-order the horses for the upcoming race.

Figure 13A:
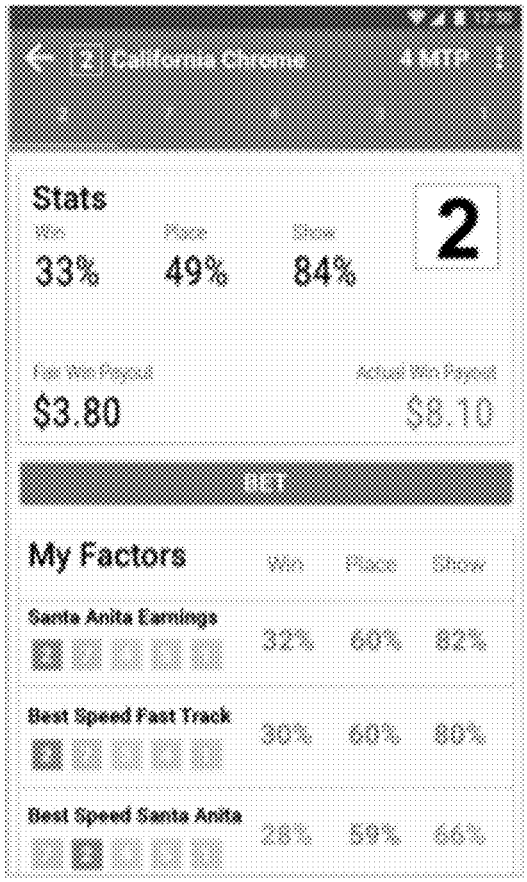
FIG. 13A is an example of the top portion of a "Wager-Oriented, Handicapping Predictions For One of the Horses In An Upcoming Race" screenshot that the present invention is configured to provide on the screen of the mobile device of a player that is using the present invention. This screenshot shows: (a) the handicapping factors the player has selected to use to handicap the upcoming race, (b) for the combination of the selected handicapping factors, the percentage of time that the horse indicated is predicted to finish so as to either win, place or show in the upcoming race.

FIG. 13A is a screenshot that can appear on a mobile device that utilizes the present invention and is an example of one the ways by which the present invention communicates its handicapping predictions. At the top part of this screenshot is shown, for horse #2 in the upcoming race, the handicapping predictions from the application of the player's selected handicapping factors to horse #2. It can be seen that the handicapping predictions are that horse #2 is predicted to have the following percentage chances of winning, placing and showing respectively: 33%, 49% and 84%.

These multiple predictions are again being presented out of support for a player who is employing a wagering strategy that involves the player making any one of multiple types of wagers (i.e., they are wager-oriented, handicapping predictions).

At the bottom of FIG. 13A is shown other related information and predictions, including: (a) some (see FIG. 13B for the other selected handicapping factors) of the player's selected handicapping factors, (b) the ranking of the contestants per each of the selected handicapping factors (based on a score assigned to each of the contestants in response to the contestant's prior race results), and (c) according to each of the selected handicapping factors and based on these rankings, a contestant's probability of winning, placing or showing in the upcoming race.

Figure 13B:
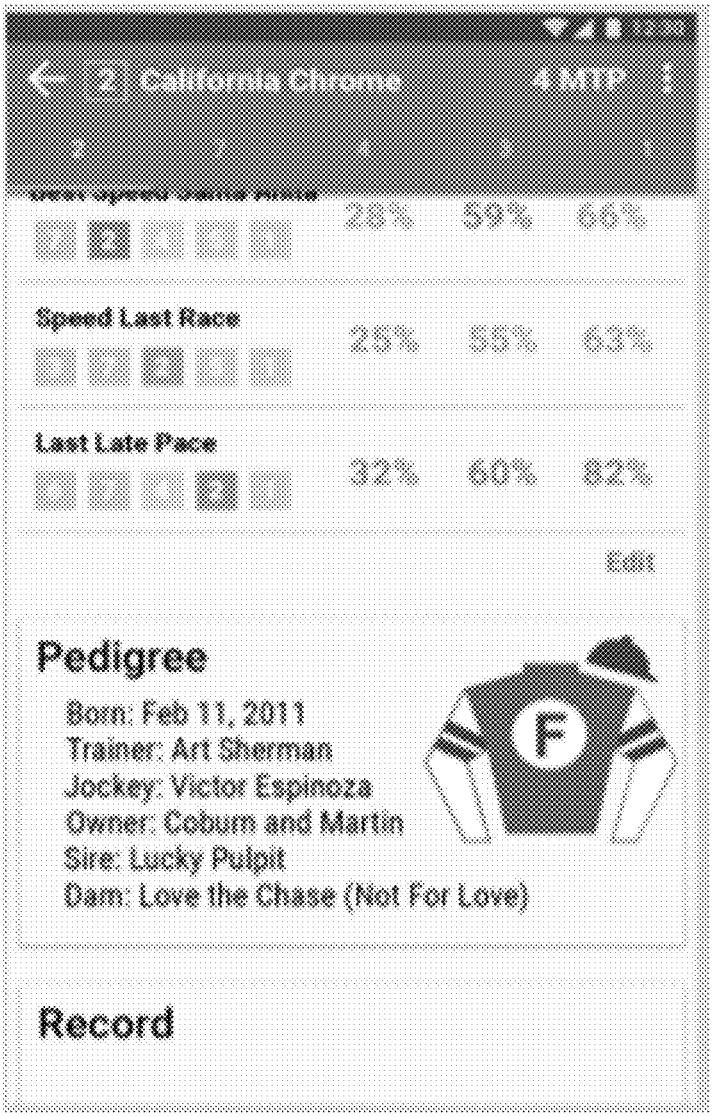
FIG. 13B is an example of a further down portion of the screenshot seen in FIG. 13A.

Since FIG. 13A is actually only the top portion of a total screenshot; scrolling down this screenshot yields FIG. 13B which contains more information pertinent to contestant or horse #2, including information pertaining to the horse's pedigree and race history, etc. In general, this screenshot has been configured to yield much of the information that could be found in the racing program of the track that is hosting the upcoming race of interest.

Although not shown in the black & white version of FIG. 13A, the boxes around the ranked ordered numbers actually have color coding that is intended to give a player or user an indication of how closely each horse is ranked in relation to the leading horse in a particular handicapping factor. For example, the number of the top ranked horse is surrounded by a box that has a green background. The boxes surrounding the numbers of horses that are ranked within 5% points of the top ranked horse are also shaded with a descending order of lighter versions of a green background. The boxes surrounding the numbers of horses that are ranked further back (10% or more) are shaded with a different color background (e.g., orange or red).

Figure 14:
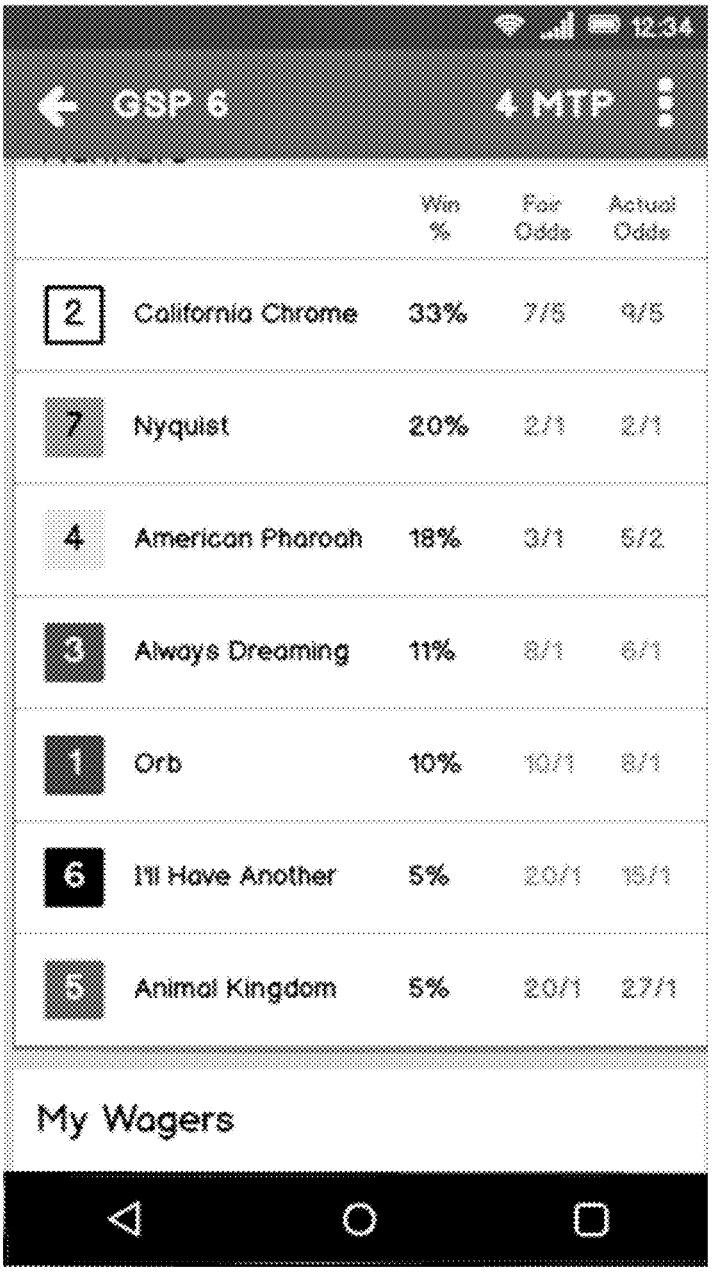
FIG. 14 is an example of a "Comparative Handicapping Predictions For All of the Horses In An Upcoming Race" screenshot that the present invention is configured to provide on the screen of the mobile device of a player that is using the present invention.

The control software of the present invention has also been configured to present its handicapping predictions according to the type of wager that a player may be considering making for an upcoming race. An example of this is shown in the screenshot of FIG. 14 for a player who is considering making only a Win wager on the upcoming race in which there are the listed, seven starters. Horse #2 which has a Win % of 33% is seen to be the top ranked horse in the upcoming race (GSP 6) for a player who is considering making a Win wager.

Since "money management" is also an important aspect of sports wagering (in addition to "handicapping" & "wagering strategy"), we see that the control software 12 of the present invention is also configured to present a middle column in FIG. 14 that contains an additional handicapping prediction which is meant to help a player better manage his or her money while pari-mutuel wagering. This middle column prediction is seen to be entitled the "Predicted Odds" or "Fair Odds" or "Fair Win Odds" and is defined as "the conversion of the calculation of the percentage probability of a specific contestant winning into the odds for the specific contestant that the prediction would expect to be showing on the tote board, or [100/(percentage probability of winning)−1]/1 and wherein the numerator in the resultant number is usually rounded off to the nearest 0.2 when the numerator has a value in the range of 0-2 (except for 0.1 and 0.5) and is usually rounded off to the nearest 0.5 when the numerator has a value in the range of 2-5 and wherein the resultant number when in the range of 1-5 may be multiplied by 5 or 2, etc. as necessary to prevent the numerator from being expressed as a decimal (e.g., 1.2/1=6/5, 1.4/1=7/5, 1.5/1=3/2 and 0.1/1=1/10)." Also provided in this screenshot is a far-right column that lists the tote board posted "Actual Odds" on each of the starters winning the upcoming race. By comparing the predicted "Fair Odds" with the "Actual Odds," a player is able to assess which of his possible Win wager options in the upcoming race is predicted to have the greatest upside.

Returning to FIG. 13A, we see that the above "Fair Odds" prediction has also been used by the present invention to compute for contestant #2 what is denoted as the predicted "Fair Win Payout" on a $2 wager. Thus, if contestant #2 has a predicted 33% probability of winning, it's predicted "Fair Odds" are 2/1 and its predicted "Fair Win Payout" will be $6 on a $2 wager. Since the tote board shows that #2 has odds of 9/5, the "Actual Win Payout" on #2 will be $5.60 on a $2 wager. A player can thus compare these payouts to help determine if he/she wants to make a win wager on contestant #2.

Recognizing that there needs to be some way to introduce and assist novice players with handicapping and placing wagers in an intelligent manner (i.e., utilizing wise "handicapping", "money management" and "wagering" techniques or strategies) that is most likely to maximize their enjoyment of wagering on order-of-finish contests, the control software of the present invention has also been configured to provide the improvement of presenting a wagering strategy or suggestions (based on its complete analysis of an upcoming event), according to a player's desired wager or bet amount on the upcoming race, on how to best apportion such an amount among the various types of available wagers and on which contestants to place such wagers.

The handicapping prediction capabilities of the present invention was used to analyze the results of prior similar race condition OOFCs to determine what would have been the best way to apportion a desired wager amount among the various types of available wagers in order to maximize a player's enjoyment (e.g., in order to yield the highest probability that a wager will yield a winning result) of wagering on order-of-finish contests. Some of the key conclusions of this analysis, regarding how to best apportion a total amount to be wagered on an upcoming race among the various types of available wagers and on which contestants to place such wagers, were:

(a) for a player who desired to wager a total wager amount (T) on only one type of wager and T is less than or equal to $25, the best type of wager to have made was a show wager (i.e., the player will win such a wager if the selected horse finishes in either the $1^{st}$, $2^{nd}$ or $3^{rd}$ position) on the horse (H1) that is ranked the highest according to its predicted probability of winning the race (i.e., T on H1 to Show)

(b) for a player who was willing to split a total wager amount (T) into two types of wagers and T is less than or equal to $25, the best type of wagers to have made was to have split the total wager amount as evenly as possible and to have made both a win wager and a show wager on the horse (H1) that is ranked the highest according to its predicted probability of winning the race (i.e., T/2 on H1 to Win and T/2 on H1 to Show), (c) for a player who was willing to split a total wager amount (T) into three types of wagers and T is less than or equal to $25, the best type of wagers to have made was to have split the total wager amount as evenly as possible and to have made both a win wager and a show wager on the horse (H1) that is ranked the highest according to its predicted probability of winning the race and a show wager on the horse (H2) that is the $2^{nd}$ highest ranked according to its predicted probability of winning the race, and if the total amount cannot be evenly split, and any excess amount after the split also going on the show wager on the horse that is ranked the highest according to its predicted probability of winning the race (i.e., T/3 on H1 to Win, T/3 on H1 to Show and T/3 on H2 to Show), (d) for a player who was willing to split a total wager amount into four types of wagers and T is less than or equal to $25, the best type of wagers to have made was to have used the types of wagers recommended for a player who is willing to split the total amount into three wagers and to also have added an exacta box wager based on either: (d1) the horses that are ranked the $1^{st}$ and $2^{nd}$ highest according to their predicted probability of winning the race (i.e., H1 and H2), or (d2) the horses that are ranked the $1^{st}$, $2^{nd}$, and $3^{rd}$ highest according to their predicted probability of winning the race (i.e., H1, H2 and H3), and the respective percentages of the total wager amount are 40-45 on H1 to Win; 25-30 on H1 to Show, 15-20 on H2 to Show and 5-10 on the Exacta Box on either H1 & H2 or H1, H2 & H3.

(e) when the total amount being wagered on an upcoming race is to be greater than $25, the first $25 of this wager should be divided as suggested by (d) above and the amount of the wager in excess of $25 (E) should be divided into various amounts and these various amounts are to be wagered on exotic wagers, preferably "box" wagers on which the horses' exact order of finish is not required as part of a winning wager, and the contestants on which these other exotic "box" wagers should be placed are chosen from the group of contestants that are the $1^{st}$, $2^{nd}$, $3^{rd}$ and $4^{th}$ ranked contestants with respect to the contestants' predicted probability of winning the upcoming race (e.g., E/2 on Trifecta Box on H1, H2, H3 & H4 and E/2 on Superfecta Box on H1, H2, H3 & H4).

To clarify how to employ such a wagering strategy, FIG. 15 presents an example of how various total wager amounts on an upcoming race that are in the range of $2 to $50 should be wagered on horses that are identified as H1, H2, H3 and H4 and which are respectively the horses that are ranked the $1^{st}$, $2^{nd}$, $3^{rd}$ and $4^{th}$ highest according to their predicted probability of winning the upcoming race.

Figure 16:
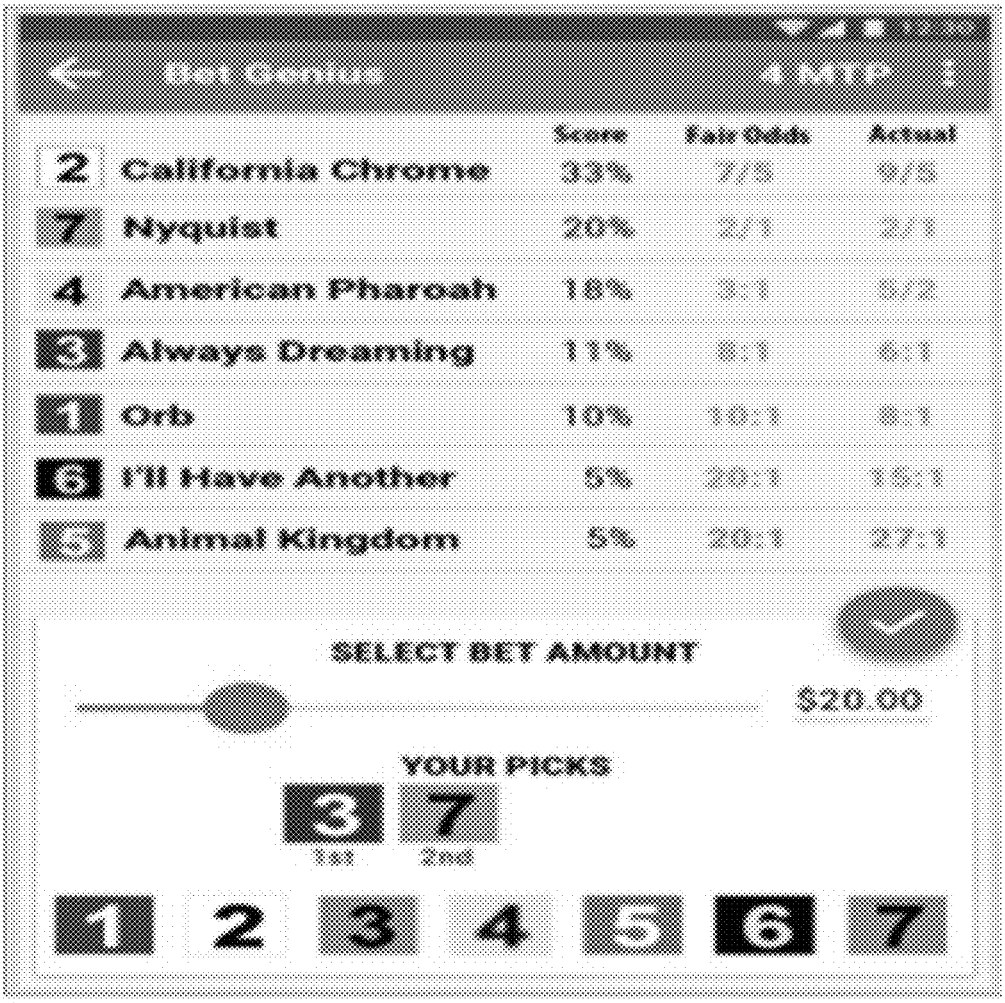
FIG. 16 is an example of a "Pick A Wager Amount and Pick The Associated Horses For A Wagering Strategy That Is Recommended Based On The Amount To-Be-Wagered" screenshot that the present invention is configured to provide on the screen of the mobile device of a player that is using the present invention. In this example, the player has elected to move the slider icon shown so as to place a $20 wager on the player's picks of horses #3 and #7.

For those players who want to employ the recommended wagering strategy of the present invention but also want to select their own predictions for the order of finish of the horses in the upcoming race, FIG. 16 shows an example of a screenshot that is provided by the present invention to facilitate the placing of the consequent wagers according to what is the total amount that the player wants to wager on the upcoming race. At the top of this screenshot is a table that lists the horses that are schedule to run in the upcoming race and their respective probabilities of winning based on the player's earlier selection of the five handicapping factors that he had the present invention utilize to calculate these winning probabilities. Also shown in the other columns in this table are the "Predicted Odds" or "Fair Odds" and the posted "Actual Odds" on either of these respective starters actually winning the upcoming race.

Beneath the table is a slider button or other selection means that allows a player to select the total amount of the wager that the player wishes to place on the upcoming race. In the example shown in FIG. 16, the player has selected $20 as the total amount to be wager on the upcoming race. From FIG. 15, we see that the wagering strategy of the present invention requires that the player only predict, in order, the top two finishers in the upcoming race and a place is shown in this screenshot for the player to indicate his or her picked, top two finishers. In this example, the player has selected horses numbered respectively #3 and #7.

Shown at the bottom of this screenshot is then another table which shows the present invention's recommended types of wagers and their amounts which total for the upcoming race to the desired amount of $20.

Figure 17A:
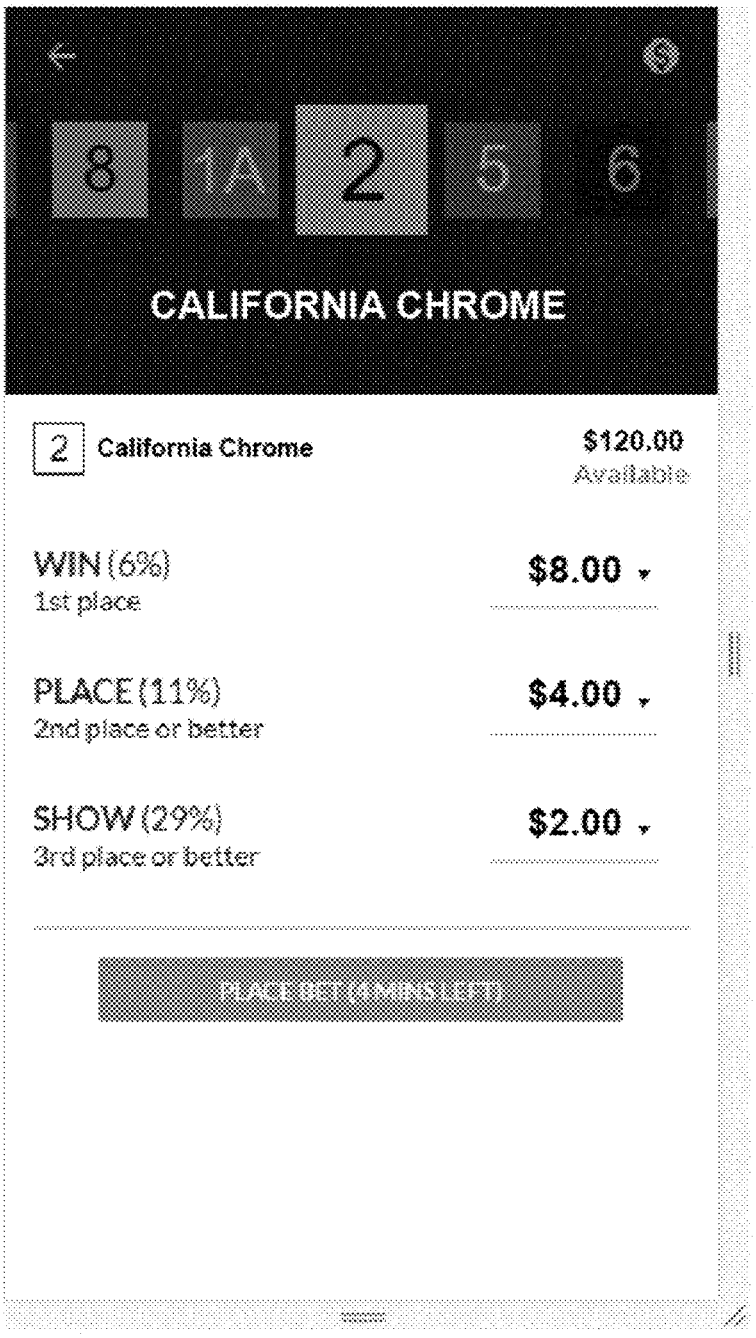
FIG. 17A is an example of a "Place Your Wager On a Specific Horse In An Upcoming Race" or "Basic Betting" screenshot that the present invention is configured to provide on the screen of the mobile device of a player that is using the present invention. In this example, the player has elected to move the slider icons shown so as to place wagers of $8, $4 and $2 for horse #2 to respectively win, place and show.
Figure 17B:
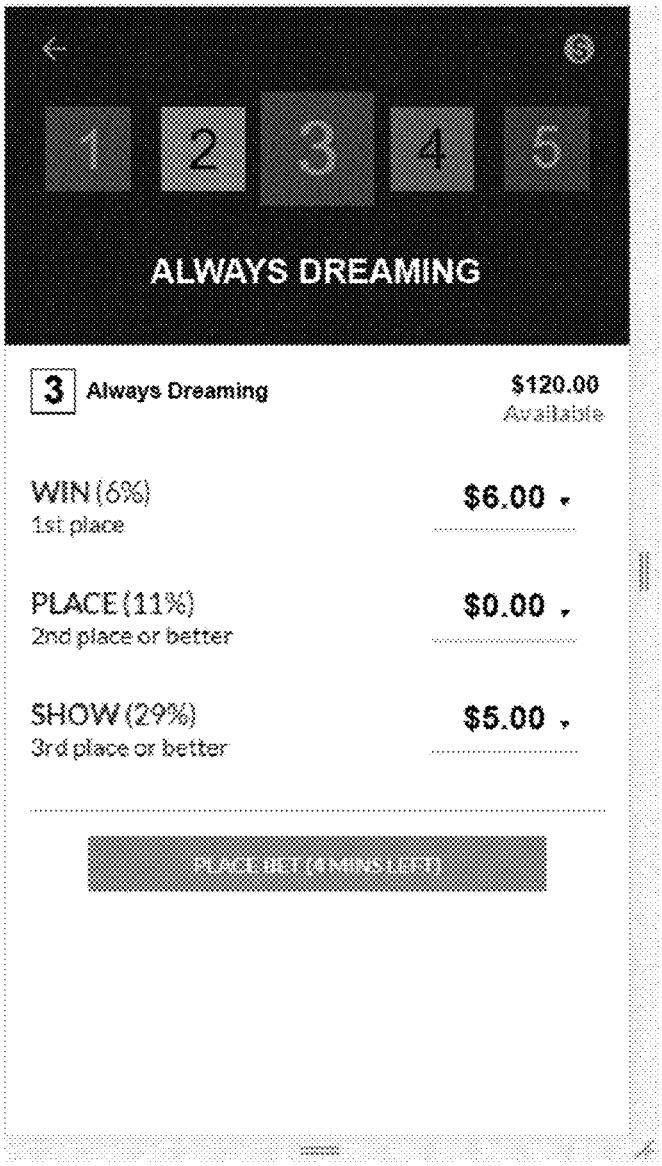
FIGS. 17B-17C are examples of the "Basic Betting" screenshots that a player would use to place some of the wagers recommended in FIG. 16.
Figure 17C:
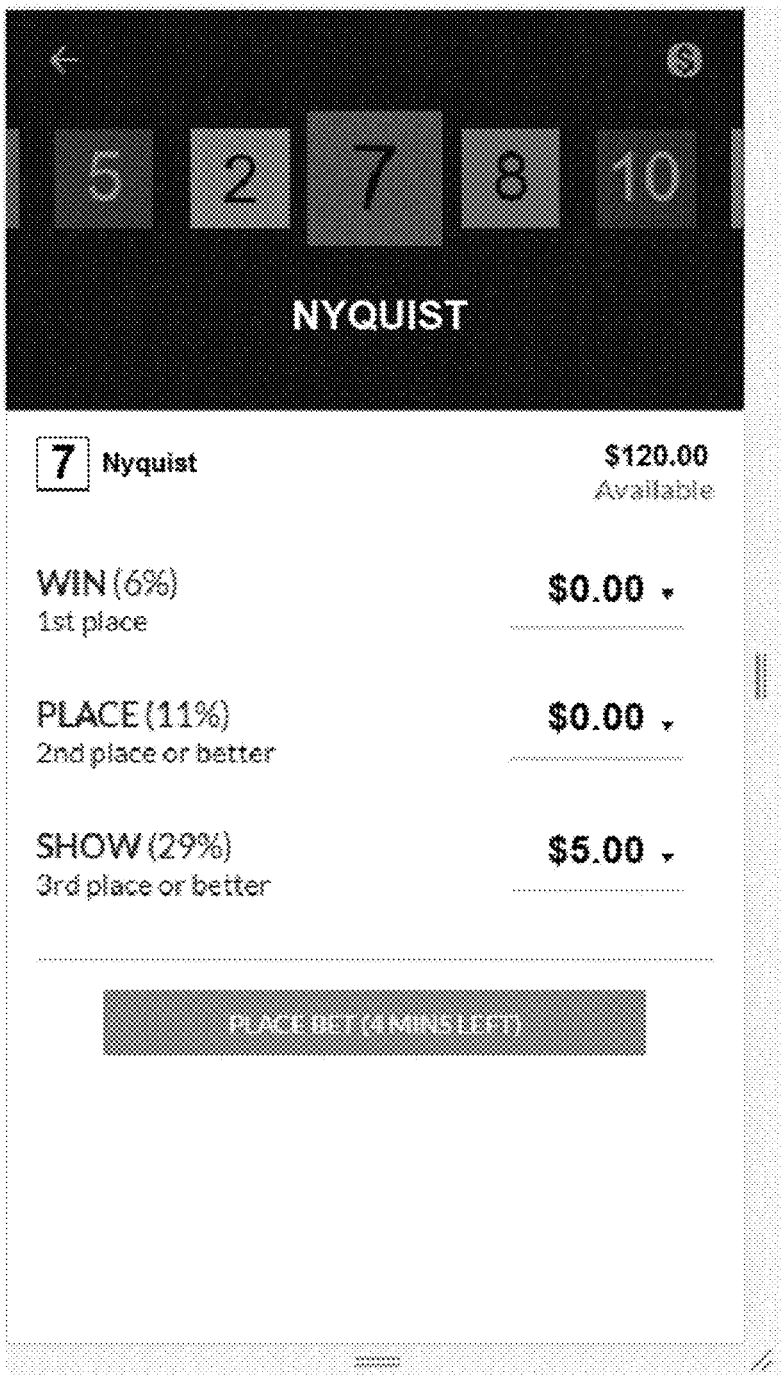

Shown in FIG. 17A is the screenshot that is configured by the present invention and is an example of a type of basic wagering input screen that is intended to be used by a player in order to allow the player to place a wager. As shown, it is organized for a specific horse and allows a player to make either a win, place or show wager. Other similar screenshots provide the opportunity for the player to place alternative types of wagers. By moving a slider from left to right for each type of wager, the player is able to increase the amount of the wager. A row at the bottom of the screenshot indicates the total amount wagered on this specific horse and indicated how much money will be left in a player's account after this wager is made. FIGS. 17B-17C show the types of similar betting screens that are used to place most of the wagers indicated in FIG. 16.

Returning to our disclosure of the present invention's handicapping factors, we note that they are divided into five categories: Speed, Pace, Resume, Humans and Pedigree; each of which is defined below:

Speed: The factors in this category describe how fast the horse has run over different time periods, distances and surfaces.

Pace: The factors in this category describe how fast the horse runs during different segments of a race. Pace is described as early (E1), middle (E2) and late (E3).

Resume: The factors in this category describe and measure things about the horse's accomplishments in past races and include information about purse levels, average finish position, class levels and earnings.

Humans: The factors in this category measure the success of the trainers and jockeys for each horse in the race.

Pedigree: The factors in this category determine each horse's genetic suitability to run over different distances and surfaces based on the progeny results of its sire and dam.

An illustrative listing of the present invention's handicapping factors are differentiated according to the above five categories and listed below:

Speed Handicapping Factors (11):

Best Lifetime Speed: This is the best speed number (e.g., the Beyer Speed Figure (available in the "Daily Racing Form") is a calculated number that reflects a horse's best winning time, the inherent speed of the track over which it was run, the time of the race, etc. On the Beyer scale, the top stakes horses in the United States and Canada earn numbers in the 100s, while extremely strong performances can rate as high as the 120s) the horse has run in its lifetime regardless of date, surface, or track condition.

Best Speed Number at Today's Track: This number represents the fastest speed number run by the horse at the track at which he is competing today. If the horse has never run on the track before, he will not have a number. Use this number more heavily when handicapping a race where several of the horses have competed at today's track, or when you are trying to find a "horse for the course"-which means a horse that may prefer one track over another.

Best Speed Turf: This number represents the horses best speed number on a turf surface. Great for handicapping turf races, but not very useful on a dirt track. There factor can be used for a horse that is running for the first time on an all weather surface, as it is believed that some horses who perform well on turf also like an all weather surface.

Best Speed Fast Track: This number represents the highest speed figure earned by the horse when running on a fast dirt track. Use sparingly when the track is muddy or sloppy.

Best Speed Off Track: This number represents the highest speed FIG. earned by the horse when running on an "Off Track"—muddy, sloppy, sealed, etc.

Best Speed Distance: This number represents the highest speed FIG. earned by the horse when running at today's distance, for example if the distance of today's race is 6 furlongs, this number would represent the best speed number this horse has earned running at the 6F distance.

Best Speed Last 3: When considering the horse's last three races, this is the highest number earned in those 3.

Avg. Speed Last 3: This factor takes the speed figures earned by the horse in his last three starts and averages them. It does not consider what distance or surface the figures were earned on.

Avg. Best 2 of Last 3: This factor looks at the last 3 races, finds the best 2 speed numbers of the three and averages those. This is a powerful factor since it tosses the lowest number which may have been due to trouble in the race, off track, etc. Again, surface, distance and condition of track are not considered in this factor.

Best Speed All Weather: This number represents the highest speed figure earned by the horse when running on an all weather surface.

Speed Last Race: This number represents the speed figure earned by the horse in his last start.

Resume Handicapping Factors (11):

Win Percent: The percentage of races the horse has won

In The Money Percent: The percentage of times the horse has run 1st, 2nd or 3rd.

Horses beaten (% avg placement last 5 races): This number looks at where a horse finished in a race and determines how many horses he beat in that race. A horse that finishes 2nd in a 5 horse race beats 3 horses, or 60% of the field. A horse that finishes 4th in a 10 horse race beats 6 horses, or 60% of the field. This number is useful for determining how well the horse has been spotted by his trainer. A horse that is beating a larger percentage of horses in his races is running at a level where he is competitive.

Distance worked since last race: This factor looks at the combined distance of the workouts for a horse since his last start. If the horse worked 3f, 4f, 4f since his last race he would have a total of 11 furlongs of work.

Days Since Last Race: The number of days since the horse's last start.

Last Finish Position: The finish position of the horse in his last start. Avg. earnings today's distance: This is a dollar figure representing the avg. amount the horse has earned per start when running at the same distance as today's race. The earnings figures are very useful to determine suitability for today's track, surface, distance, etc.

Avg. earnings today's track: This is a dollar figure representing the avg. amount the horse has earned per start when running at the same track as today's race is being run.

Avg. turf earnings: This is a dollar figure representing the avg. amount the horse has earned per start when running on the turf.

Avg. all weather earnings: This is a dollar figure representing the avg. amount the horse has earned per start when running on an all weather surface. For example, polytrack or Tapeta surfaces. Keeneland, Arlington, Del Mar, and Turfway are examples of racetracks that use an all weather surface. Certain horses tend to prefer or dislike all weather surfaces and this factor is useful for determining that.

Avg. off track earnings: This is a dollar figure representing the avg. amount the horse has earned per start when running on an "off track". That is a track that is rated as muddy, sloppy, etc.

Avg. lifetime earnings: This is a dollar figure representing the avg. amount the horse has earned per start for his career. This figure includes all races without regard to track, surface, condition, etc.

Pace Handicapping Factors (8):

Last E1 Pace: This number represents how fast the horse ran from the start of the race to the $1^{st}$ call. In a sprint race (7F or less) the $1^{st}$ call will be at 2F, in a route (races longer than 7f) the first call will be at 4F. Turning on E1 pace by itself will give you a good idea of which horses will be running early, and help you determine how the race may shape up.

Last E2 Pace: This number represents how fast the horse ran from the start of the race to the 2nd call. In a sprint race (7F or less) the $2nd^{t}$ call will be at 4F, in a route (races longer than 7f) the $2^{nd}$ call will be at 6F.

Last Turn Time: This number represents how fast the horse ran between the first two calls, and is calculated by subtracting the E1 pace number from the E2 pace number.

Avg. of last 3 E1 pace: This number represents the average of the last 3 E1 pace figures the horse has earned.

Avg. of last 3 E2 pace: This number represents the average of the last 3 E2 pace figures the horse has earned.

Avg. of last 3 turn times: This number represents the average of the last 3 turn time figures the horse has earned.

Last late pace: This number represents how fast the horse ran from the $2^{nd}$ call to the finish of the race. Late pace is often a big factor in turf route races and again should be looked at by itself to see which horses may be running late.

Avg. of last 3 late pace: This number represents the average of the last 3 late pace figures the horse has earned.

Human Handicapping Factors (6):

Trainer current meet: This number tells you the percentage of races that the trainer has won at the current meet (same racetrack), as today's race. This factor is more useful when the meet has been running for several weeks, or when the trainer is running several horses at the meet.

Jockey current meet: This number tells you the percentage of races that the jockey has won at the current meet (same racetrack), as todays race. This factor is more useful when the meet has been running for several weeks, or when the jockey is riding several horses at the meet.

Trainer current meet: This number tells you the percentage of races that the trainer has won during the current year. Trainer and Jockey win percentages are very important. The best trainers get the best horses, and the best jockeys ride those horses.

Jockey current meet: This number tells you the percentage of races that the jockey has won during the current year. Trainer and Jockey win percentages are very important. The best trainers get the best horses, and the best jockeys ride those horses.

Trainer Jockey Combo Win % Meet: This factor looks at the number of times the trainer and jockey have teamed up during the meet and provides their win percentage. If Castellano had ridden for Pletcher 10 times during the meet and won 6 races the percentage would be 60%.

Trainer Jockey Combo ROI Meet: This factor looks at the number of times the trainer and jockey have teamed up during the meet and provides the ROI on a flat $2 win bet.

Pedigree Handicapping Factors (4):

Dirt Pedigree rating: Pedigree rating measures the quality and suitability of the horse's breeding for races run on the dirt. Based on an analysis of hundreds of thousands of starts in North America, each start of all offspring from the Sire, Dam, and Damsire are evaluated and measured for their individual racing aptitudes and preferences. Pedigree factors are very useful in evaluating Maiden Races, when there is limited information about the starters.

Mud Pedigree rating: Pedigree rating measures the quality and suitability of the horse's breeding for races run on wet dirt surface. Obviously, this factor is most important when evaluating a race being run in bad weather.

Turf Pedigree rating: Pedigree rating measures the quality and suitability of the horse's breeding for races run on the turf.

Distance Pedigree rating: Pedigree rating measures the quality and suitability of the horse's breeding for races run at today's distance.

The foregoing is considered as illustrative only of the principles of the present invention. Further, since numerous modifications and changes will readily occur to those skilled in the art, it is not desired to limit the invention to the exact construction and operation shown and described herein.

For example, while the present invention has been described herein as applying to horse races, it should be understood that it can apply to any number of various types of order-of-finish contests (OOFCs). This assumes that there is historical data on the past performances of the potential contestants in prior order-of-finish contests (POOFCs) that have similar race conditions to that of an upcoming order-of-finish contest (UOOFC) on which a player is interested in placing a wager (UOOFCw). The presence of this historical data allows one to bring skill into the wagering process by enabling the prediction of which one of a plurality of possible handicapping factors is likely to be the most-accurate in predicting the outcome of an UOOFCw.

Accordingly, all suitable modifications and equivalents may be resorted to, falling within the scope of the invention that is hereafter set forth in the claims to the invention.

We claim:

1. A system for allowing a player with a mobile device that has a display, in an environment of networked computing devices that connect over a network, to use said mobile device to place a wager of any one of a plurality of available wager types on any one of a plurality of upcoming order-of-finish contests (UOOFCs) that are being held at any one of a plurality of venues, each of said UOOFC having a specified race condition and a plurality of contestants and wherein each contestant has a history of past performances in prior order-of-finish contests (POOFCs) including those that were conducted under similar race conditions, and wherein a player is required, for each said wager placed on said UOOFCs, to make contestant selection choices and place wagers on said contestant selection choices of a defined amount from the funds available in an account of said player, said system comprising:

a server that connects to said network and has a processor with memory and software that controls the operation of said processor, a database that resides in said memory and stores racing data that includes said race conditions and the identity of said contestants for each of said UOOFCs, said history of past performances in said POOFCs for each of said contestants and the race conditions associated with each of said POOFCs, wherein said race conditions stored in said database and used to identify said POOFCsrc having similar race conditions to that of said UOOFCw are chosen from the group including the: (1) name of the track, (2) distance of the race, (3) type of track surface, (4) number of contestants in a race, (5) class of the race, and (6) condition of the track surface, wherein said software includes instructions that cause said server to cooperate with said mobile device to provide on said display of said mobile device a user interface for:

(a) registering said player to use said system, (b) establishing an account for said player that includes said funds available to said player for wagering on said UOOFCs using said system, (c) providing on said display of said mobile device a plurality of handicapping factors from which said player may select a handicapping factor to assist said player with predicting the outcome of an UOOFC on which said player is interested in placing a wager (UOOFCw)

(d) identifying for said player which one of said plurality of handicapping factors is likely to predict the outcome of said UOOFCw, wherein identifying which one of said plurality of handicapping factors is likely to predict the outcome of said UOOFCw includes: (i) identifying from said database, based on said race conditions of said UOOFCw, a plurality of POOFCs having similar race conditions to that of said UOOFCw (POOFCsrc), (ii) analyzing said plurality of POOFCsrc to determine which one of said plurality of handicapping factors was predictive of the outcome of said plurality of POOFCsrc, and (iii) indicating to said player that said determined handicapping factor is said one which is likely to predict the outcome of said UOOFCw, (e) presenting, upon the selection by said player of a handicapping factor for use by said player in predicting the outcome of said UOOFCw and applying said selected handicapping factor to said contestants in said UOOFCw a predicted outcome for said UOOFCw, (f) enabling said player to place a wager on a selected contestant in said UOOFCw and wherein said placed wager is chosen from the group of said plurality of available wager types and said placed wager is for a specified amount from said funds available to said player for wagering.

2. The system as recited in claim 1, wherein:

said software further includes instructions that cause said server to cooperate with said mobile device to provide on said display of said mobile device a user interface for:

(g) identifying for said player a wagering strategy that includes those chosen from the group of: (i) a recommended type of wager and the contestant in said UOOFCw on which to place said recommended type of wager, (ii) how to pre-race, apportion a player's desired total wager among the specific contestants in said UOOFCw, and (iii) how to apportion a player's desired wager among the various types of available wagers on which contestants can place such wagers.

3. The system as recited in claim 2, wherein:

said predicted outcome includes a percentage probability that said chosen wager type on said selected contestant will be a winning wager.

4. The system as recited in claim 1, wherein:

said predicted outcome includes a percentage probability, which is calculated by only utilizing said data stored in said database, that said chosen wager type on said selected contestant will be a winning wager.

5. The system as recited in claim 1, wherein:

said predicted outcome includes an outcome for said UOOFCw that is chosen from the group of a probability of each of said contestants actually: (i) winning said UOOFCw, (ii) finishing second in said UOOFCw, (iii) finishing third in said UOOFCw, (iv) finishing fourth in said UOOFCw, (v) finishing fifth in said UOOFCw, (vi) placing in said UOOFCw, and (vii) showing in said UOOFCw.

6. A system for allowing a player with a mobile device that has a display, in an environment of networked computing devices that connect over a network, to use said mobile device to place a wager, of any one of a plurality of available wager types, on any one of a plurality of upcoming order-of-finish contests (UOOFCs) that are being held at any one of a plurality of venues, each of said UOOFCs having a specified race condition and a plurality of contestants and wherein each contestant has a history of past performances in prior order-of-finish contests (POOFCs), said system comprising:

a server that connects to said network and has a processor with memory and software that controls the operation of said processor, wherein said software includes instructions that cause said server to cooperate with said mobile device to provide on said display of said mobile device a user interface for identifying for said player a wagering strategy that includes a recommended type of wager and a contestant in said UOOFCw on which to place said recommended type of wager.

7. The system as recited in claim 6, wherein:

said recommended wager type is selected in order to allow said player to achieve winning result for said UOOFCw.

8. The system as recited in claim 6, wherein:

said recommended wager type is based on a total wager amount (T) that said player desires to make on said UOOFCw and a number of ways in which said player desires to spit said total wager amount (T) amongst said plurality of available wager types.

9. A process for allowing a player with a mobile device that has a display with a touch-screen interface, in an environment of networked computing devices that connect over a network, to use said mobile device to place a wager of any one of a plurality of available wager types on any one of a plurality of upcoming order-of-finish contests (UOOFCs) that are being held at any one of a plurality of venues, each of said UOOFC having a specified race condition and a plurality of contestants and wherein each contestant has a history of past performances in prior order-of-finish contests (POOFCs), including those that were conducted under similar race conditions, and wherein a player is required, for each said wager placed on said UOOFCs, to make contestant selection choices and place wagers on said contestant selection choices of a defined amount from the funds available in an account of said player, said process comprising the steps of:

providing a server that connects to said network and has a processor with memory and software that controls the operation of said processor, providing a database that resides in said memory and stores racing data that includes said race conditions and the identity of said contestants for each of said UOOFCs, said history of past performances in said POOFCs for each of said contestants and the race conditions associated with each of said POOFCs, wherein said race conditions stored in said database and used to identify said POOFCsrc having similar race conditions to that of said UOOFCw are chosen from the group including the: (1) name of the track, (2) distance of the race, (3) type of track surface, (4) number of contestants in a race, (5) class of the race, and (6) condition of the track surface, wherein said software includes instructions that cause said server to cooperate with said mobile device to provide on said display of said mobile device a user interface for:

(a) registering said player to use said system, (b) establishing an account for said player that includes said funds available to said player for wagering on said UOOFCs using said system, (c) providing on said display of said mobile device a plurality of handicapping factors from which said player may select a handicapping factor to assist said player with predicting the outcome of an UOOFC on which said player is interested in placing a wager (UOOFCw)

(d) identifying for said player which one of said plurality of handicapping factors is likely to predict the outcome of said UOOFCw, wherein identifying which one of said plurality of handicapping factors is likely to predict the outcome of said UOOFCw includes: (i) identifying from said database, based on said race conditions of said UOOFCw, a plurality of POOFCs having similar race conditions to that of said UOOFCw (POOFCsrc), (ii) analyzing said plurality of POOFCsrc to determine which one of said plurality of handicapping factors was predictive of the outcome of said plurality of POOFCsrc, and (iii) indicating to said player that said determined handicapping factor is said one which is likely to predict the outcome of said UOOFCw, (e) presenting, upon the selection by said player of a handicapping factor for use by said player in predicting the outcome of said UOOFCw and applying said selected handicapping factor to said contestants in said UOOFCw a predicted outcome for said UOOFCw, (f) enabling said player to place a wager on a selected contestant in said UOOFCw and wherein said placed wager is chosen from the group of said plurality of available wager types and said placed wager is for a specified amount from said funds available to said player for wagering.

10. The process as recited in claim 9, wherein:

said software further includes instructions that cause said server to cooperate with said mobile device to provide on said display of said mobile device a user interface for:

(g) identifying for said player a wagering strategy that includes those chosen from the group of: (i) a recommended type of wager and the contestant in said UOOFCw on which to place said recommended type of wager, (ii) how to pre-race, apportion a player's desired total wager among the specific contestants in said UOOFCw, and (iii) how to apportion a player's desired wager among the various types of available wagers on which contestants can place such wagers.

11. The process as recited in claim 10, wherein:

said predicted outcome includes a percentage probability that said chosen wager type on said selected contestant will be a winning wager.

12. The process as recited in claim 10, wherein:

said predicted outcome includes an outcome for said UOOFCw that is chosen from the group of a probability of each of said contestants actually: (i) winning said UOOFCw, (ii) finishing second in said UOOFCw, (iii) finishing third in said UOOFCw, (iv) finishing fourth in said UOOFCw, (v) finishing fifth in said UOOFCw, (vi) placing in said UOOFCw, and (vii) showing in said UOOFCw.

13. The process as recited in claim 9, wherein:

said predicted outcome includes a percentage probability, which is calculated by only utilizing said data stored in said database, that said chosen wager type on said selected contestant will be a winning wager.

14. The process as recited in claim 9, wherein:

said predicted outcome includes an outcome for said UOOFCw that is chosen from the group of a probability of each of said contestants actually: (i) winning said UOOFCw, (ii) finishing second in said UOOFCw, (iii) finishing third in said UOOFCw, (iv) finishing fourth in said UOOFCw, (v) finishing fifth in said UOOFCw, (vi) placing in said UOOFCw, and (vii) showing in said UOOFCw.

15. A non-transitory, computer-readable medium storing instructions that, when executed, cause a service-providing server, which has a processor with memory that includes a database, to provide a service which allows a player with a mobile device, that has a display, to use said mobile device to place a wager of any one of a plurality of available wager types on any one of a plurality of upcoming order-of-finish contests (UOOFCs) that are being held at any one of a plurality of venues, each of said UOOFC having a specified race condition and a plurality of contestants and wherein each contestant has a history of past performances in prior order-of-finish contests (POOFCs) including those that were conducted under similar race conditions, and wherein a player is required, for each said wager placed on said UOOFCs, to make contestant selection choices and place wagers on said contestant selection choices of a defined amount from the funds available in an account of said player, and wherein said database stores racing data that includes said race conditions and the identity of said contestants for each of said UOOFCs, said history of the past performances in said POOFCs for each of said contestants and the race conditions associated with each of said POOFCs, said instructions on said non-transitory, computer-readable medium comprising the steps of enabling said server to cooperate with said mobile device to provide on said display of said mobile device a user interface for:

wherein said race conditions stored in said database and used to identify said POOFCsrc having similar race conditions to that of said UOOFCw are chosen from the group including the: (1) name of the track, (2) distance of the race, (3) type of track surface, (4) number of contestants in a race, (5) class of the race, and (6) condition of the track surface, (a) registering said player to use said system, (b) establishing an account for said player that includes said funds available to said player for wagering on said UOOFCs using said system, (c) providing on said display of said mobile device a plurality of handicapping factors from which said player may select a handicapping factor to assist said player with predicting the outcome of an UOOFC on which said player is interested in placing a wager (UOOFCw)

(d) identifying for said player which one of said plurality of handicapping factors is likely to predict the outcome of said UOOFCw, wherein identifying which one of said plurality of handicapping factors is likely to predict the outcome of said UOOFCw includes: (i) identifying from said database, based on said race conditions of said UOOFCw, a plurality of POOFCs having similar race conditions to that of said UOOFCw (POOFCsrc), (ii) analyzing said plurality of POOFCsrc to determine which one of said plurality of handicapping factors was predictive of the outcome of said plurality of POOFCsrc, and (iii) indicating to said player that said determined handicapping factor is said one which is likely to predict the outcome of said UOOFCw, (e) presenting, upon the selection by said player of a handicapping factor for use by said player in predicting the outcome of said UOOFCw and applying said selected handicapping factor to said contestants in said UOOFCw a predicted outcome for said UOOFCw, (f) enabling said player to place a wager on a selected contestant in said UOOFCw and wherein said placed wager is chosen from the group of said plurality of available wager types and said placed wager is for a specified amount from said funds available to said player for wagering.

16. The non-transitory, computer-readable medium as recited in claim 15, wherein said software further includes instructions that cause said server to cooperate with said mobile device to provide on said display of said mobile device a user interface for:

(g) identifying for said player a wagering strategy that includes those chosen from the group of: (i) a recommended type of wager and the contestant in said UOOFCw on which to place said recommended type of wager, (ii) how to pre-race, apportion a player's desired total wager among the specific contestants in said UOOFCw, and (iii) how to apportion a player's desired wager among the various types of available wagers on which contestants can place such wagers.

17. The non-transitory, computer-readable medium as recited in claim 16, wherein:

said predicted outcome includes a percentage probability that said chosen wager type on said selected contestant will be a winning wager.

18. The non-transitory, computer-readable medium as recited in claim 16, wherein:

said predicted outcome includes an outcome for said UOOFCw that is chosen from the group of a probability of each of said contestants actually: (i) winning said UOOFCw, (ii) finishing second in said UOOFCw, (iii) finishing third in said UOOFCw, (iv) finishing fourth in said UOOFCw, (v) finishing fifth in said UOOFCw, (vi) placing in said UOOFCw, and (vii) showing in said UOOFCw.

19. The non-transitory, computer-readable medium as recited in claim 15, wherein:

said predicted outcome includes a percentage probability, which is calculated by only utilizing said data stored in said database, that said chosen wager type on said selected contestant will be a winning wager.

20. The non-transitory, computer-readable medium as recited in claim 15, wherein:

said predicted outcome includes an outcome for said UOOFCw that is chosen from the group of a probability of each of said contestants actually: (i) winning said UOOFCw, (ii) finishing second in said UOOFCw, (iii) finishing third in said UOOFCw, (iv) finishing fourth in said UOOFCw, (v) finishing fifth in said UOOFCw, (vi) placing in said UOOFCw, and (vii) showing in said UOOFCw.

* * * * *